US010856681B2

(12) United States Patent
Abdiye

(10) Patent No.: US 10,856,681 B2
(45) Date of Patent: Dec. 8, 2020

(54) LID FOR BEVERAGE CONTAINERS

(71) Applicant: Abbey Abdiye, Burnaby (CA)

(72) Inventor: Abbey Abdiye, Burnaby (CA)

( * ) Notice: Subject to any disclaimer, the term of this patent is extended or adjusted under 35 U.S.C. 154(b) by 0 days.

(21) Appl. No.: 15/113,306

(22) PCT Filed: Jan. 23, 2015

(86) PCT No.: PCT/CA2015/050048
§ 371 (c)(1),
(2) Date: Jul. 21, 2016

(87) PCT Pub. No.: WO2015/109409
PCT Pub. Date: Jul. 30, 2015

(65) Prior Publication Data

US 2017/0020316 A1 Jan. 26, 2017

Related U.S. Application Data

(60) Provisional application No. 61/930,480, filed on Jan. 23, 2014.

(51) Int. Cl.

| | |
|---|---|
| ***A47G 19/22*** | (2006.01) |
| ***B65D 43/02*** | (2006.01) |
| ***B65D 51/24*** | (2006.01) |
| ***B65D 51/18*** | (2006.01) |
| ***B65D 47/06*** | (2006.01) |
| ***B65D 47/20*** | (2006.01) |

(52) U.S. Cl.
CPC ..... *A47G 19/2272* (2013.01); *B65D 43/0212* (2013.01); *B65D 47/06* (2013.01); *B65D 47/20* (2013.01); *B65D 51/18* (2013.01); *B65D 51/245* (2013.01); *B65D 2203/00* (2013.01); *B65D 2231/022* (2013.01); *B65D 2543/00027* (2013.01); *B65D 2543/00046* (2013.01); *B65D 2543/0074* (2013.01); *B65D 2543/00638* (2013.01); *B65D 2543/00685* (2013.01); *B65D 2543/00805* (2013.01); *B65D 2543/00925* (2013.01)

(58) Field of Classification Search
CPC ..... B65D 43/0212; B65D 51/245; B65D 2231/022; A47G 19/2227
See application file for complete search history.

(56) References Cited

U.S. PATENT DOCUMENTS

| | | | | | |
|---|---|---|---|---|---|
| 3,532,244 | A * | 10/1970 | George, Jr. | B65D 45/322 215/272 |
| 3,934,745 | A * | 1/1976 | Lovell | B65D 41/185 215/224 |
| 3,999,677 | A | 12/1976 | Oberkircher | |
| 5,035,320 | A * | 7/1991 | Plone | A47G 21/004 206/219 |
| 6,158,155 | A | 12/2000 | Boney | |

(Continued)

*Primary Examiner* — Andrew T Kirsch

(57) ABSTRACT

Lids for a container having an external peripheral rim at the upper end thereof, the lid comprising a top wall; a peripheral skirt depending downward from the top wall and having a bottom-most edge larger in diameter than the rim of the container and an inside surface with a locking mechanism disposed between the bottom-most edge and the top wall and being adapted to receive and engage the rim; and a plurality of slots defined in skirt extending upward from the bottom-most edge to divide the skirt into individually resiliently flexible skirt portions.

15 Claims, 29 Drawing Sheets

(56) References Cited

U.S. PATENT DOCUMENTS

| | | | | |
|---|---|---|---|---|
| 6,230,924 | B1 * | 5/2001 | Weiss | B29C 51/32 220/366.1 |
| 6,938,768 | B2 * | 9/2005 | Ferretti | B65D 43/0212 116/307 |
| 2002/0179604 | A1 | 12/2002 | Germain et al. | |
| 2004/0011803 | A1 * | 1/2004 | D'Amato | B65D 43/0212 220/780 |
| 2005/0035018 | A1 * | 2/2005 | McRobbie | B65D 43/0212 206/459.5 |
| 2006/0124501 | A1 | 6/2006 | McNeely | |
| 2011/0089066 | A1 | 4/2011 | Knipe | |
| 2012/0261417 | A1 | 10/2012 | Tabor | |
| 2012/0325768 | A1 | 12/2012 | Biesecker et al. | |

* cited by examiner

LID FOR BEVERAGE CONTAINERS

BACKGROUND OF THE INVENTION

1. Field of the Invention

The present disclosure generally relates to lids for beverage cups and containers providing secure attachment of the lid to the cup and mechanisms for displaying advertising messages on the lid.

2. Description of the Related Art

Lids of beverage cups, containers and the like are in wide use for various everyday applications, such as disposable soft drink cups used in the restaurant industry on which the lid clips onto the rim of the container by the application of pressure. Likewise, lids for hot drinks are commonly used at coffee places, cafes and in restaurants. Such lids are often not properly sealed to avoid spillage and require some pressure to seal the lids onto a cup. Some prior art lids are fiddly and require some effort to use. And often the prior art lids do not provide an adequate seal or may be accidentally dislodged from the cup resulting in spillage and inconvenience to the users. Accordingly, there is a need for lids that securely attach to the beverage cups or containers and are easy to use, require little effort to close and seal the lid, and are stable and resistant to outside conditions. As well, it would be advantageous to have a lid that is suitable for having unique mechanisms for displaying advertising or promotional messages thereon that would provide added value to the restaurant industry.

SUMMARY OF THE INVENTION

In order to address some of the shortcomings in the prior art, some aspects of the present invention provide lids that securely attach to the beverage cups or containers with minimal effort as a result of a unique locking mechanism. The locking mechanism is easy to use, requires little effort to close and seal the lid, and is stable and resistant to outside conditions. In other aspects, the present invention provides lids having unique mechanisms for displaying advertising or promotional messages thereon that would provide added value to the restaurant industry.

In some embodiments, the present invention provides a lid for a container having an external peripheral rim at the upper end thereof, the lid comprising a top wall; a peripheral skirt depending downward from the top wall and having a bottom-most edge larger in diameter than the rim of the container and an inside surface with a locking mechanism disposed between the bottom-most edge and the top wall and being adapted to receive and engage the rim; and a plurality of slots defined in skirt extending upward from the bottom-most edge to divide the skirt into individually resiliently flexible skirt portions.

In some embodiments, the locking mechanism may comprise a circumferential rounded channel provided on the inside surface at an interface between the skirt and the top wall and adapted to receive an upper circumferential portion of the rim, and a plurality of peripherally spaced inwardly directed projections on the inside surface below the rounded channel and adapted to underlie and engage a bottom portion of the rim. In some embodiments, the inwardly directed projection may comprises a downwardly and inwardly sloping concave upper surface adapted to cradle the bottom portion of the rim, an inward convex intermediate surface adapted to underlie the bottom portion of the rim, and a downwardly and outwardly sloping lower surface extending from the intermediate surface to the bottom-most edge of the skirt, wherein as the bottom-most edge of the skirt is telescoped onto the rim in placement of the lid onto the container, the lower surface rides on the rim to deflect its skirt portion outward against a bias provided by the resilience of the skirt portion material until the intermediate surface clears the rim and the rim seats into the rounded channel and into engagement with the upper surface as the skirt portion springs back to a resting state.

In some embodiments, the locking mechanism may comprise a circumferential rounded channel provided on the inside surface at an interface between the skirt and the top wall and adapted to receive the rim, an inward annular flange projecting from the inside surface below the rounded channel and adapted to underlie and engage a bottom portion of the rim, and a flared downward lower surface extending from the annular flange to the bottom-most edge of the skirt, wherein as the lower surface of the skirt is telescoped onto the rim in placement of the lid onto the container, the lower surface rides on the rim to deflect its skirt portion outward against a bias provided by the resilience of the skirt portion material until the annular flange clears the rim and the rim seats into the rounded channel and into engagement with the annular flange as the skirt portion springs back to a resting state.

In some embodiments, the slots extend fully to the top wall to expose a portion of the rim for enabling visual confirmation that the rim is fully seated within the locking mechanism. In some embodiments may be provided a circumferential vertical flange extending downward from the top wall and adapted to abut an inside surface of the container adjacent the rim. In some embodiments, a plurality of vertical tabs extending downward from the top wall may be provided at locations that peripherally coincide with the slots and adapted to abut an inside surface of the container adjacent the rim.

In some embodiments, the lid may further including a straw receiver comprising a hole defined in the top wall and an inwardly tapered cylinder that projects downward from a bottom surface of the top wall about the hole, the tapered cylinder defining a bottom straw receiver edge adapted to closely receiving a straw therein and provide a seal between the straw and the bottom straw receiver edge. In some embodiments, a valve may be provided on the tapered cylinder for preventing liquid from escaping via the tapered cylinder in the absence of a straw in the tapered cylinder. In some embodiments, the valve may comprise a flap hingedly connected to the bottom straw receiver edge by a segment of resiliently flexible material, and adapted to cover the bottom straw receiver edge in a resting state for providing a seal, and be moveable away from the bottom straw receiver edge upon insertion of a straw through the tapered cylinder.

In some embodiment, the lid may further including a disk member adapted for rotatably connecting onto the top wall in a manner that the disk member obscures an upper surface of the top wall, the disk member further defining a window through which a portion of the upper surface is visible, thereby enabling portions of the upper surface to be displayed through the window by rotating the disk member relative to the top wall.

In some embodiments, a plurality of promotional or advertising messages may be provided on the upper surface positioned such that one or more of the messages may be selectively displayed through the window by rotation of the disk relative to the top wall.

In some embodiments, the lid may further include detents cooperating between the disk and the top wall that enable the window to be biased in one or more positions relative to the upper surface.

In some embodiments, the disk member includes a second hole coincident with the hole on the top wall, and one or more tabs extending downward from the disk member about the second hole and being adapted to fit within the tapered cylinder and extend past the bottom-most edge thereof, the one or more tabs including an outward flange portion adapted to releasably engage the bottom-most edge to resist the withdrawal of the one or more tabs from the tapered cylinder, wherein the connection between the one or more tabs and the tapered cylinder permits rotation of the disk member relative to the top wall. A plurality of messages may be provided on the upper surface positioned such that one or more of the messages may be selectively displayed through the window by rotation of the disk relative to the top wall. In some embodiments, the lid may further include detents cooperating between the disk and the top wall that enable the window to be biased in one or more positions relative to the upper surface.

In some embodiments, the lid may further include a plurality of bubble indicators protruding from the top surface of the top wall, each being inwardly deformable upon an application of an inward force. In some embodiments, an in-mold label (IML) may be formed into the top surface of the top wall and overlying the bubble indicators, and the thickness of the material of each bubble indicator may be between about 25%-45% of the thickness of the material of the top wall.

BRIEF DESCRIPTION OF THE DRAWINGS

For a better understanding of the present invention and to show more clearly how it may be carried into effect, reference is made by way of example to the accompanying drawings in which.

DETAILED DESCRIPTION

Figure 1:
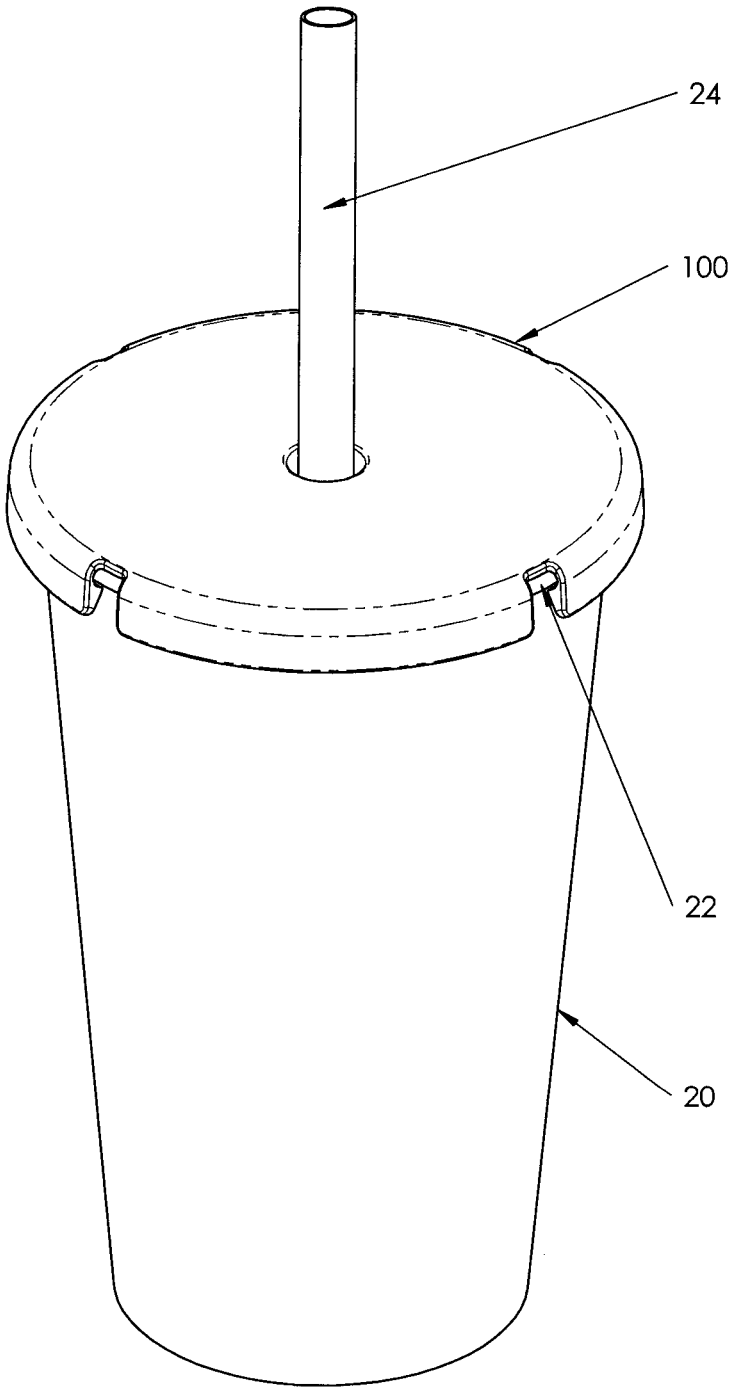
FIG. 1 is a perspective view of an embodiment of a lid of the present invention on a beverage cup.
Figure 2:
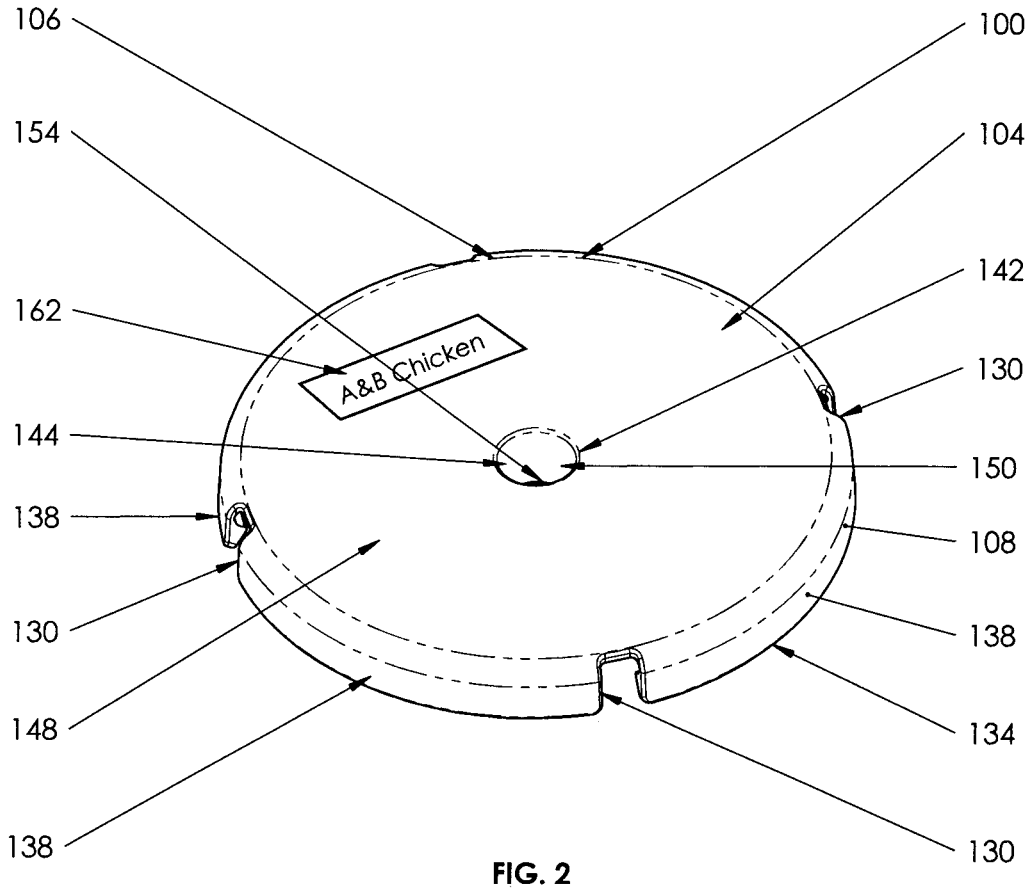
FIG. 2 is a perspective view of the lid of FIG. 1.
Figure 3:
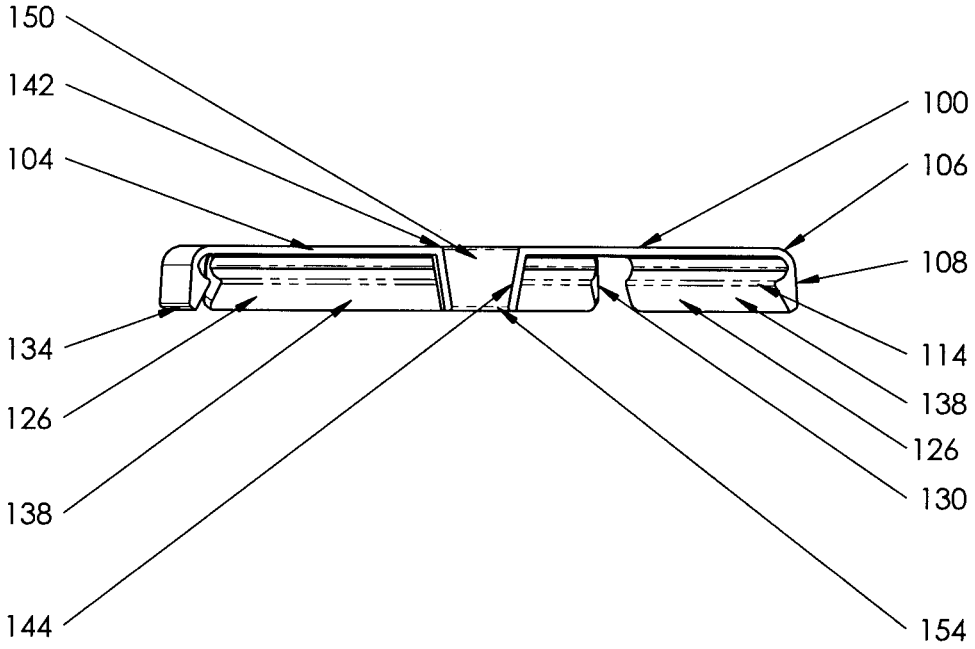
FIG. 3 is a cross section view of the lid of FIG. 1.
Figure 4:
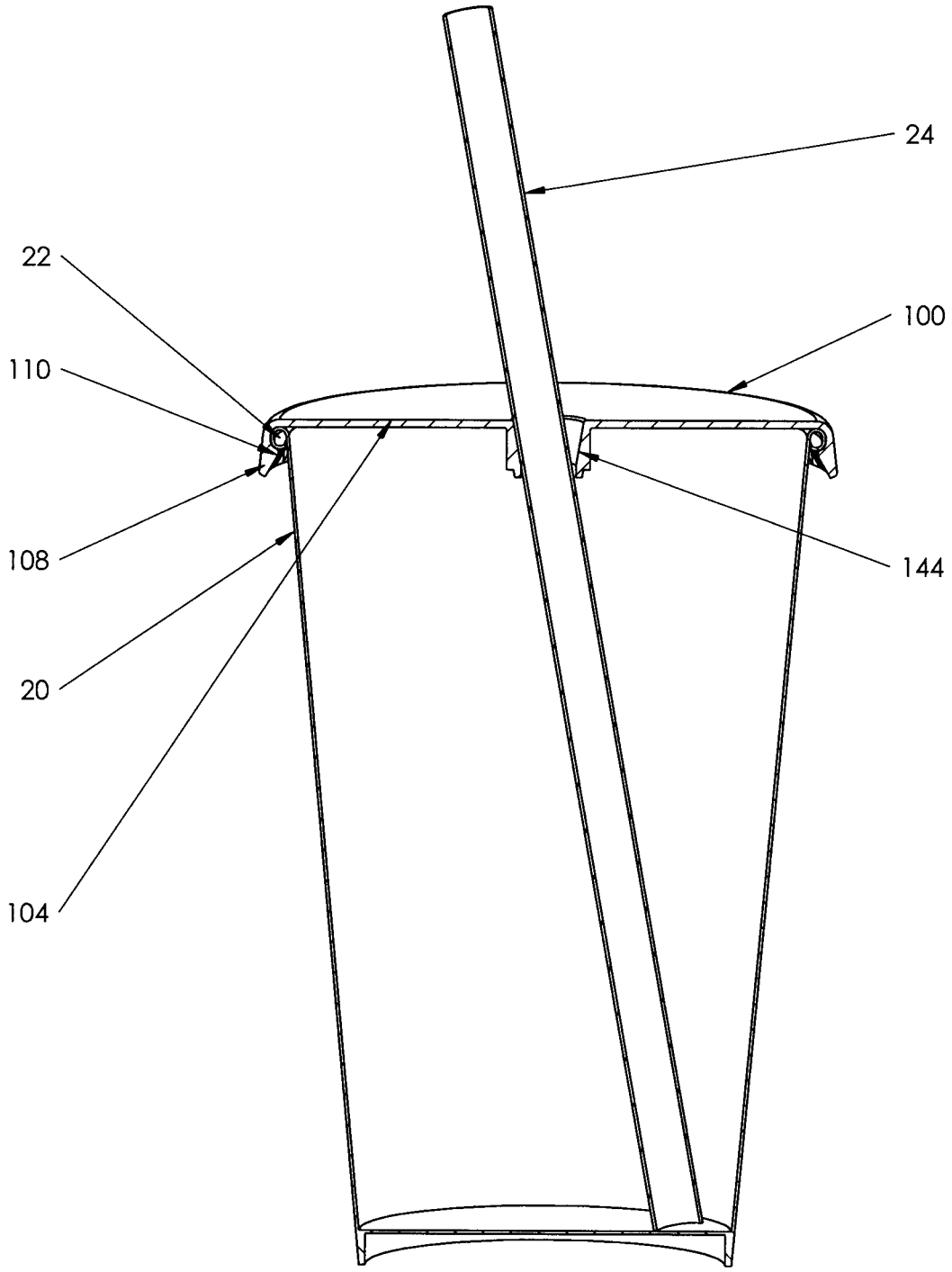
FIG. 4 is a cross section view of the lid of FIG. 1 on a beverage cup.

For the purposes of promoting an understanding of the principles of the invention, reference will now be made to the exemplary embodiments illustrated in the drawings, and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would occur to one skilled in the relevant art and having possession of this disclosure, are to be considered within the scope of the invention.

Figure 13:
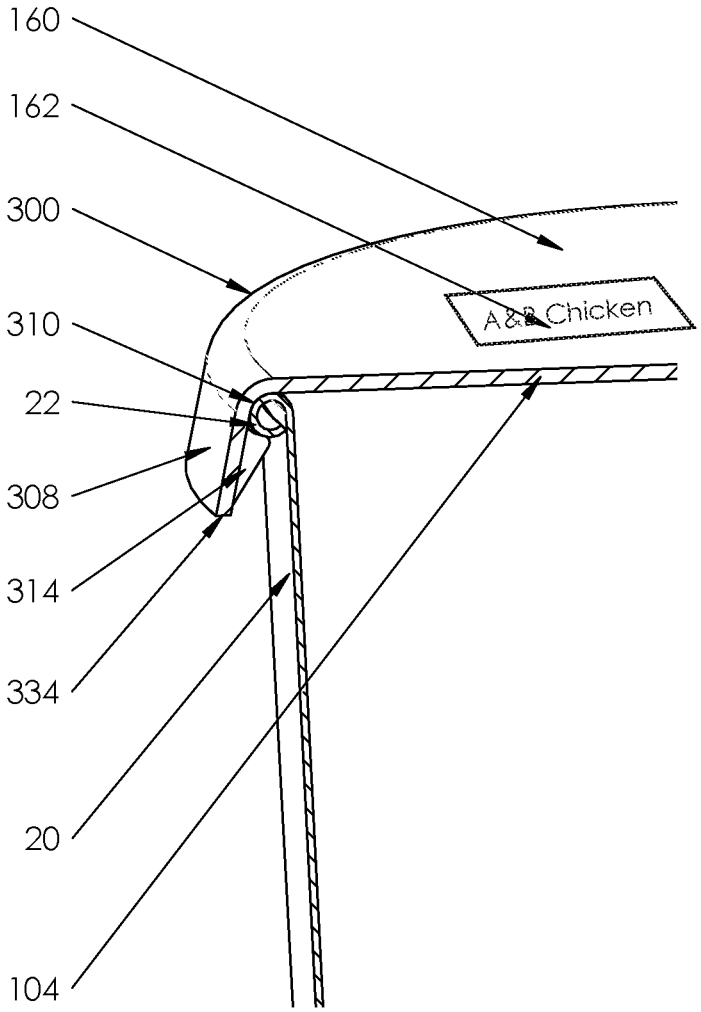
FIG. 13 is close up cross section view of the lid of FIG. 10 on a beverage cup.
Figure 14:
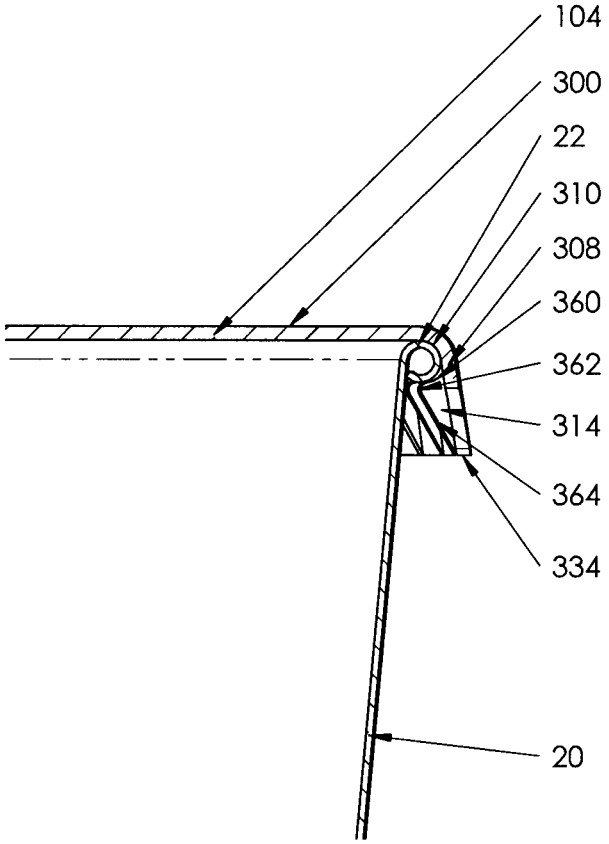
FIG. 14 is close up cross section view of the lid of FIG. 10 on a beverage cup.

Referring to FIGS. 1-4 there is show an embodiment of a lid 100 in accordance to the present invention operably connected to a conventional container such as beverage cup 20. Beverage cup 20 is well known in the art and comprises an upwardly flared body 22 that terminates in an external beaded or rolled rim 24 as best shown in FIG. 13. Beverage cup 20 may be disposable, made of paper in which case the rim is usually of the rolled kind, or the cup may be reusable and of a thicker material in which case the rim may be a bead variety.

The lid 100 is made of a thin thermoplastic material which is relatively flexible but not relatively elastic, and is of a size to fit the specific cup or container 20 for which it is intended. The lid 100 comprises a disk shaped planar top wall 104 and a peripheral skirt 108 extending downward from the edge 106 of the top wall 104. The skirt 108 includes a snap-fit locking mechanism comprised of an annular internal round channel 110 adjacent to the top wall 104 and an annular inwardly projecting edge portion 114 on the lower portion of the rounded channel 110 that is adapted to underlie and directly engage the bottom portion of the rim 22 of the container to retain the lid thereon. The rounded channel 110 has a cross section that closely conforms to the cross-sectional shape of the bead or rim 22 of an associated beverage cup or container 20, thereby the round channel 110 is adapted to closely receive the rim 22 to provide a liquid tight seal there between. The skirt 108 includes an outwardly flared flange portion 122 that extends below the raised edge portion 114. The flared flange portion 122 thereby defines an internal surface 126 that tapers inwards towards the raised edge 114. Provided in the skirt 108 at spaced intervals are a plurality of windows or slots 130 that extend from the bottom-most edge 134 of the skirt 108 to the edge 106 of the top wall 104. The slots 130 divide the skirt 108 into skirt portions 138, which provide added outward flexibility to the skirt portions 138 to enable them to be deflected outwards when connecting or removing the lid 100 onto or from the rim 22 of the cup 20. The slots 130 around the skirt of the lid allow the skirt portions to flex outward more easily than if the slots were not present. This feature makes it possible to increase the amount of undercut by the raised edge portion 114 for securing the lid onto the cup rim. The undercut feature is designed with a ramped internal surface 126 on the bottom that makes it easy to put onto the rim of the cup, and a much flatter ramp on the top by virtue of the rounded channel 110 that makes it more difficult for the lid to come off. In order to take the lid off the cup it is necessary to flex the section of material between the slots—the skirt portions—outward. Without the slots, skirt would be more rigid and therefore more difficult to flex outward during removal of the lid.

In addition, the slots 130 also expose a portion of the rim 22 and thereby provide a window by which one can confirm that the rim 22 is received completely within the round channel 110 and thereby confirm that the lid 100 is sealed and locked in an operative position on the rim 22. In some embodiments, a status display may be provided based on different status indictors such as color, symbols and the like that may be visible through the slots 130 by which a user could readily ascertain the status of the lid 100.

The internal diameter of the bottom-most edge 134 of skirt 108 is greater than the external width of the rim 22. As the lid 100 is to be applied to the cup 22, the bottom-most edge 134 of the skirt 108 will initially freely pass into the rim 22 of the cup 20 and the internal surface 126 of the flared flange portion 122 will pass around the rim 22. As the lid 100 is moved downwardly relative to the cup 20, internal surface 126 will ride on the upper portion of the rim 22 causing the skirt portions 138 to be cammed or deflected outwardly. As the lid 100 is continued to be moved downwardly onto the cup 20, the lower annular edge 114 will ride over the rim 22, which will then seat into the rounded channel 110 once the annular edge 114 moves beneath the outer surface of the rim 22. The outward deflection force of the skirt portions 138 thus being removed, the skirt portions 138 return to their resting state on account of their material resilience, and thereby force the raised edge portion 114 to undercut and engage the lower surface of the rim 22 and lock the lid 100 onto the cup 20.

When it is desired to remove the lid 100 from the cup 20, the bottom-most edge 134 of the skirt 108 is gripped and moved upwardly and outwardly. Due to the ability of the skirt portions 138 to flex outward, and the inwardly and downwardly tapering of the lower portion of the rounded channel 110, when the lid is moved upwardly, the raised edge portion 114 will be cammed outwardly over the bottom surface of the rim 22 to eventually clear the rim 22 and allow the rim 22 to be withdrawn from the rounded channel 110.

On the top wall 104 is provided a hole 142 and an inwardly tapered cylinder 144 that projects downward from the bottom surface 146 and the edge defined by the hole 142 such that the top surface 148 of the top wall is continuous with the inside surface 150 of the tapered cylinder 144. The tapered cylinder or straw receiver 144 terminates in a bottom straw receiver edge 154 that defines a hole dimensioned to closely receive a drink straw 24 therein, thereby providing a measure of a seal between the straw and the bottom inside surface of the straw receiver 144 that limits the escape of liquid via the straw receiver.

The upper surface of the top wall 104 on lid 100 defines a circular central area 160, but which can be configured to be octagonal and the like. The center area is designed to provide a flat platform on which advertising messages 162 may be placed, for example of any product and services of a fast food restaurant. The message materials (not shown) can be written or printed in a paper, plastic, transparent screen materials and the like which can be placed on the upper lid using different labeling processes. Preferably the advertising message may be molded into the lid material by in-mold labeling processes. Other materials can be used such as transparent LED display, see-through LED screen, transparent hologram screen film, transparent LCD, flexible image display, digital screen and the like. This advertising medium is beneficial for fast food restaurants to advertise or promote their products and services using the center areas by simply printing advertising messages using removable or permanent stickers, printed messages on the lids, and using in-mold labeling (IML) processes for high volume and to save printing costs. Other method of utilizing the center areas can be using peel-off stickers, scratch & win stickers, grand prize stickers and the like. Further, the various components of labeling can be made of different materials and by any suitable manufacturing processes. Other advertising labeling for example can be using invisible or changeable plastic materials, electronic LCD or LED displays, 3D displays and the like. The enclosable lid 100 can be made to any size, shape and designed required by fast food industry, beverage companies and the like. The center areas can be useful for fast food restaurants or others to utilize the space for various purposes such as product launch, branding, awareness, promotion, employment opportunity, grand prizes, interactive games and the like. In another instance, third party companies such as telephone or utilities in cooperation with a fast food restaurant as a cross promotion can advertise on the lid to promote their brand awareness. For example, a fast food restaurant can provide discounts with the promotional messages and these discounts can be redeemed by a customer on his or her next purchase by submitting the 100 to cashiers at any participating fast food restaurants.

One or more drain holes (not shown) may also be provided in the central area of the top wall to provide drainage of liquid back into the cup 20.

After clipping on the lid 100 onto a suitable cup, a user for example inserts a straw 24 through the straw receiver 144 and into the cup to draw the liquid contents of the cup 22 through the straw. The locking mechanism on the skirt 108 prevents the lid from being accidentally dislodged from the cup 20.

Figure 5:
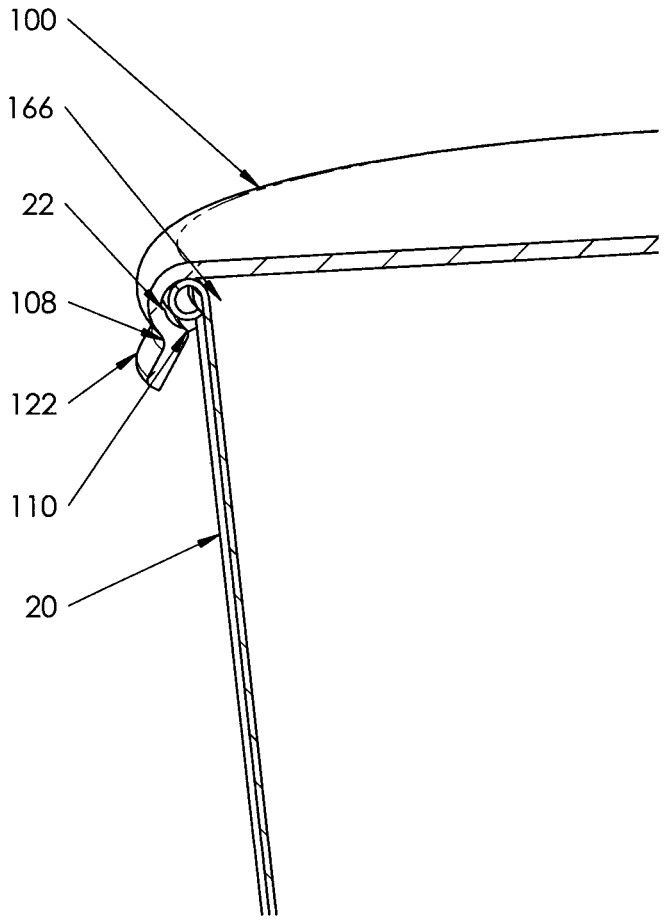
FIG. 5 is close up cross section view of another embodiment of a lid on a beverage cup.

In some embodiments, the lid 100 may be provided with vertical downward extending tabs 166 from the bottom surface of the top wall at locations peripherally coincident with the slots 130 but located laterally inward from the edge 106 of the top wall by a distance approximately equal to the thickness of the bead or rim 22 on the cup 20. Thus the bead or rim 22 would fit between the rounded channel 110 and the tabs 166 as shown in FIG. 5. In such embodiments, the tabs 166 provide a more secure liquid seal against the bead or rim 22 at locations coincident with the slots 130.

Figure 6:
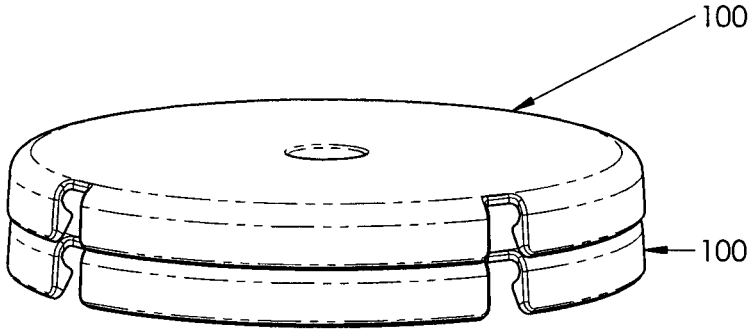
FIG. 6 is a perspective view of the lids of FIG. 1 in a stacked configuration.

As shown in FIG. 6, the lids 100 are stackable so that users can save storage space on a lid counter, warehouse and the like by simply stacking the lid on the top of each other.

Figure 7:
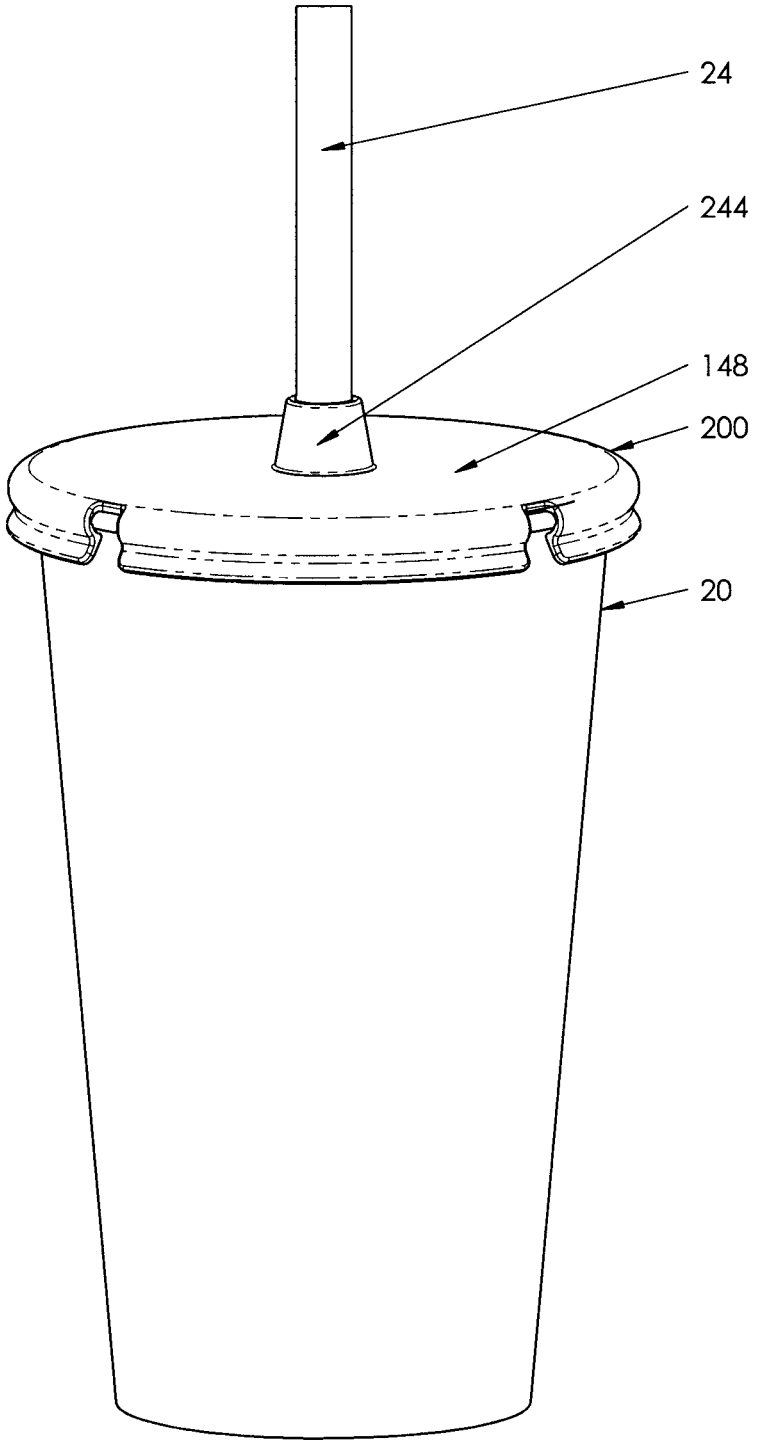
FIG. 7 is a perspective view of another embodiment of a lid of the present invention on a beverage cup.
Figure 8:
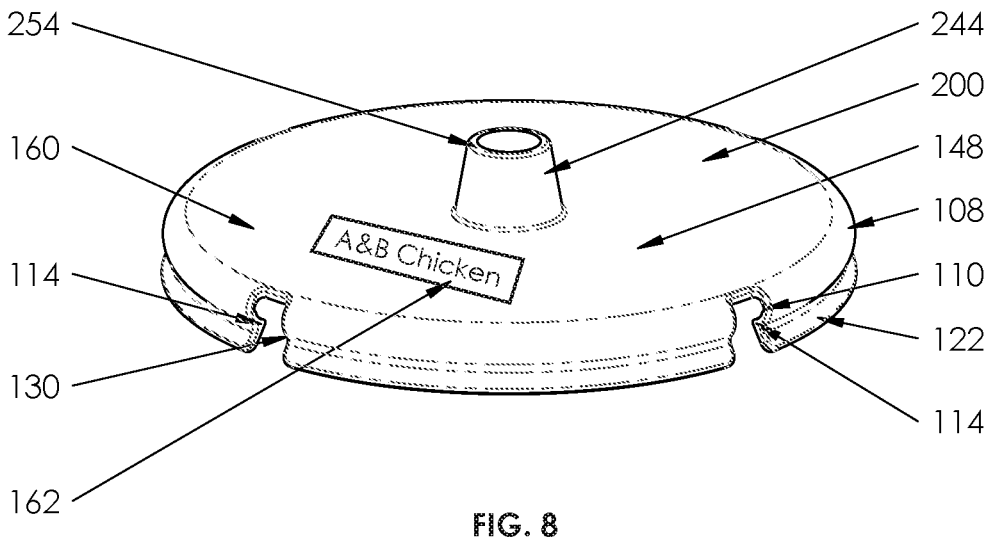
FIG. 8 is a perspective view of the lid of FIG. 7.
Figure 9:
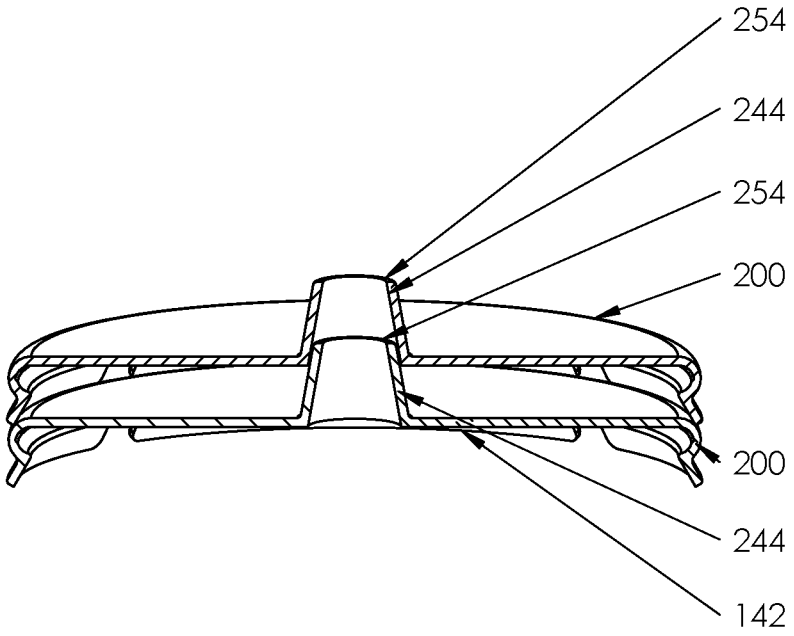
FIG. 9 is a cross section view of the lids of FIG. 7 in a stacked configuration.
Figure 10:
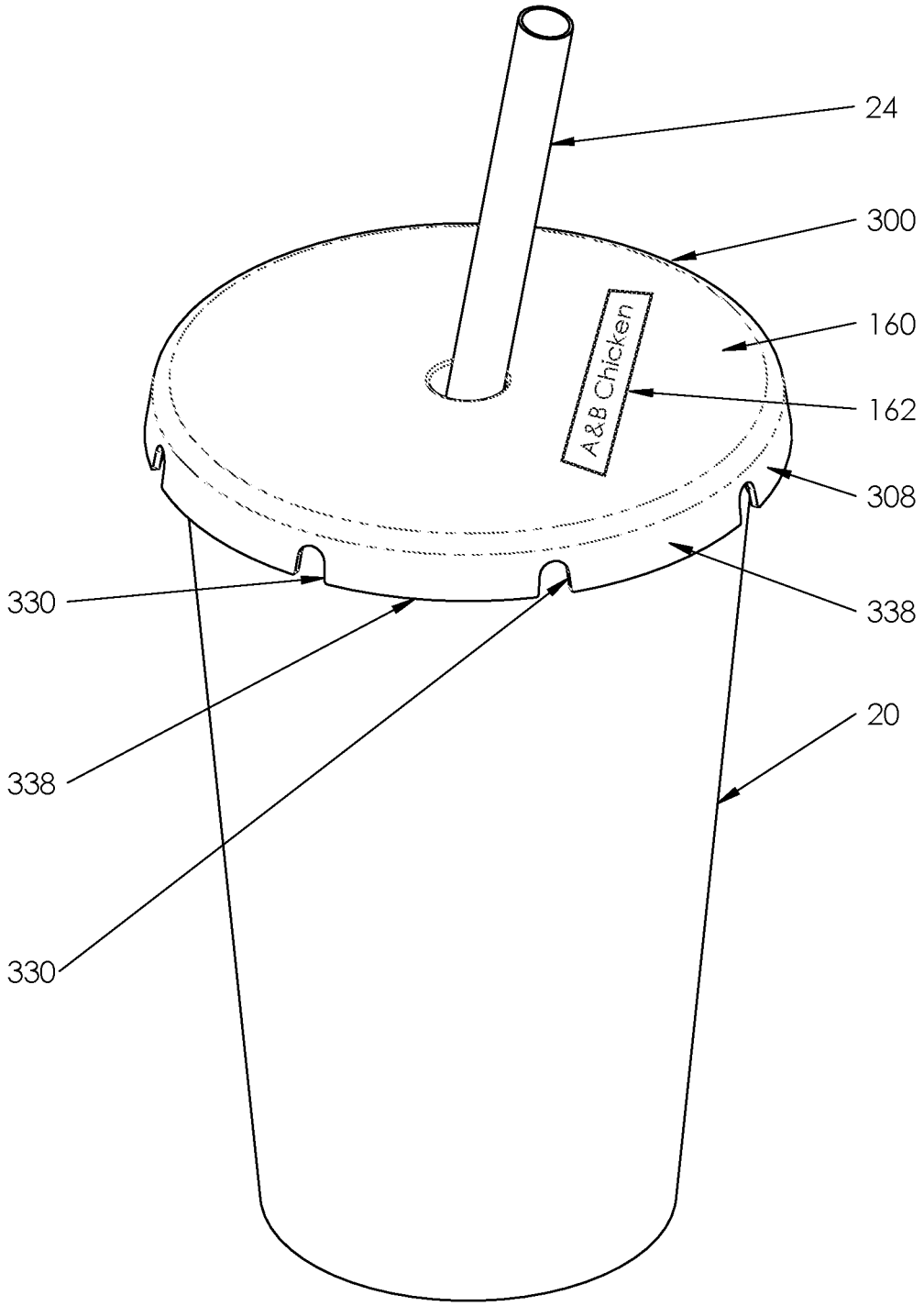
FIG. 10 is a perspective view of another embodiment of a lid of the present invention on a beverage cup.
Figure 11:
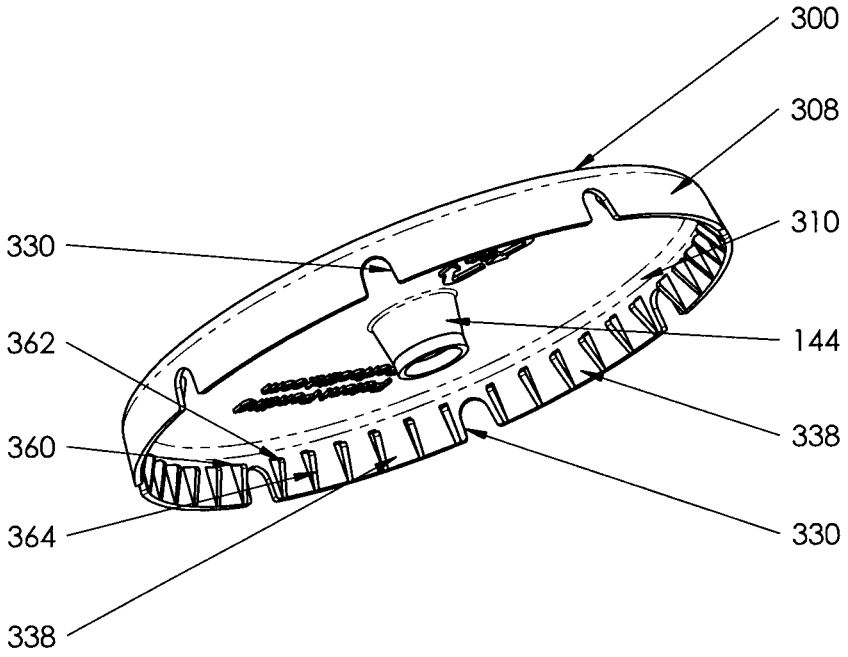
FIG. 11 is a perspective view of the lid of FIG. 10.
Figure 12:
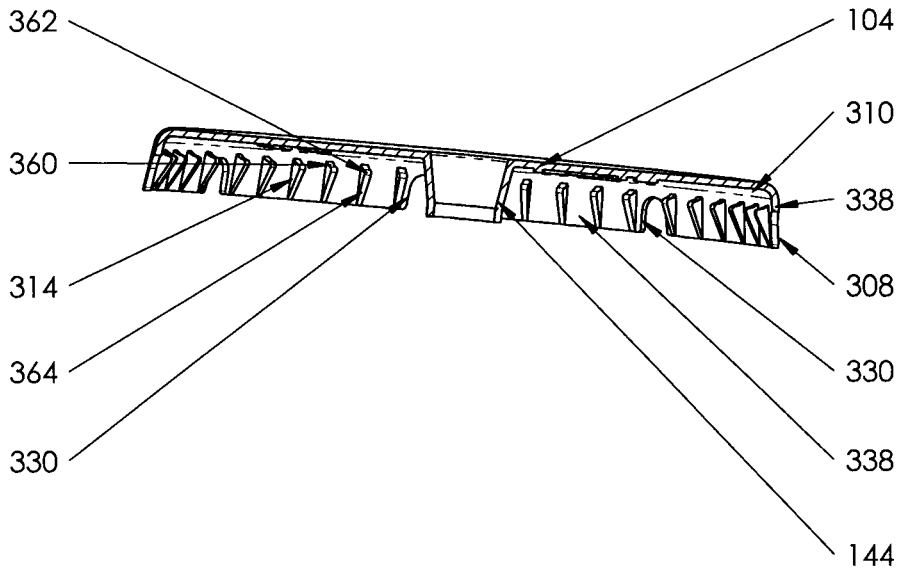
FIG. 12 is a cross section view of the lid of FIG. 10.

Referring to FIGS. 7-9, there is shown another embodiment of a closure lid in accordance to the present invention. Lid 200 is similar to lid 100 in all aspects except that the straw receiver 244 extends upwardly from the top surface 148. The terminal edge 254 of the straw receiver is preferably dimensioned to be narrower than the hole 142 (and base of the straw receiver) for improved stackability as shown in FIG. 9, wherein the terminal end of the straw receiver of one lid 200 fits within the hole 148 of another lid 200 that is stacked on top of the first.

As with the other embodiments described above, the upper surface of the top wall 104 on lid 200 defines the circular central area 160, which can be advantageously used as a platform for advertisement or promotional messages 162 as previously described.

Referring to FIGS. 10-15, there is shown another embodiment of a closure lid in accordance to the present invention. Lid 300 is similar to lid 100 in all aspects except the configuration of the skirt and locking mechanism. Lid 300 comprises a disk shaped planar top wall 104 and a peripheral skirt 308 extending downward from the edge of the top wall 104. The inside surface of the skirt 308 includes a snap-fit locking mechanism comprised of an annular internal round channel portion 310 adjacent to the top wall 104, and a plurality of peripherally spaced projections 314 projecting radially inwardly from the skirt 308. Each projection 314 comprises a downwardly and inwardly sloping concave upper surface 360, an inward convex intermediate surface 362, and a downwardly and outwardly sloping lower surface 364. The upper surface 360, intermediate surface 362 and lower surface 364 transition into each other. The upper surface 360 is adapted to underlie and directly engage the bottom portion of the rim 22 of the container to retain the lid thereon. In aggregate, the concave upper surfaces 360 of the projections 314 define a lower rounded channel which, in conjunction with the rounded channel 310, is adapted to receive the rim 22 of the cup there within. Close contact between the upper round channel 310 and the rim 22 provides a liquid tight seal. The intermediate convex portion 362 of the projections 314 is adapted to underlie and engage the bottom surface of the rim 22. The lower surfaces 364 of the projections 314 in aggregate provide internal surfaces that taper inwards towards the intermediate surfaces 362. Provided in the skirt 308 at spaced intervals are a plurality of windows or slots 330 that extend part way from the bottom-most edge 334 of the skirt 308 toward the top wall 104. The slots 330 divide the skirt 308 into skirt portions 338, which provides added outward flexibility to the skirt portions 338 to enable them to be deflected outwards when connecting or removing the lid 300 onto or from the rim 22 of the cup 20. The slots 330 around the skirt of the lid allow the skirt portions to flex outward easier than if the slots were not present. This feature makes it possible to increase the amount of undercut by the convex intermediate surfaces 362 of the projections 314 to provide a more robust locking mechanism for securing the lid 300 onto the cup rim 22. The undercut feature is designed with the sloped ramp aspect provided by the lower surfaces 364 on the bottom that makes it easy to put the lid 300 onto the cup 20, and a flatter ramp feature provided by the upper surfaces 360 on the top that interferes with the rim 22 making it more difficult for the lid 300 to be accidentally dislodged from the cup 20. In order to take the lid off the cup, it is necessary to flex a skirt portion 338 outward while lifting the lid away from the cup. Without the slots 330, this section of plastic would be more rigid and therefore more difficult to flex outward, making it more difficult for the user to intentionally remove the lid.

The internal diameter of the bottom-most edge 334 of skirt 308 is greater than the external width of the rim 22. As the lid 300 is to be applied to the cup 22, the bottom-most edge 334 will initially freely pass into the rim 22 of the cup 20 and the sloped lower surfaces 364 of the projections 314 will pass over the rim 22. As the lid 300 is moved downwardly relative to the cup 20, the internal lower surfaces 364 will ride on the upper portion of the rim 22 causing the skirt portions 338 to be cammed or deflected outwardly. As the lid 300 is continued to be moved downwardly onto the cup 20, the convex intermediate surfaces 362 of the projections 314 will ride over the rim 22, which will then seat into the conforming channel defined by the upper rounded channel 310 and the concave upper surfaces 360 of the projections 314 once the intermediate surfaces 362 move beneath the outer surface of the rim 22. The outward deflection of the skirt portions 338 thus being removed, the skirt portions will return to their resting state on account of their material resilience, and thereby force the intermediate surfaces 362 to undercut and engage the lower surface of the rim 22 to lock the lid 300 onto the cup 20.

When it is desired to remove the lid 300 from the cup 20, the bottom-most edge 334 of the skirt 308 gripped and moved upwardly and outwardly. Due to the ability of the skirt portions 338 to flex outward, and the inwardly and downwardly tapering of the lower portion of the rounded channel 310, when the lid is moved upwardly, the intermediate surface 362 will be cammed outwardly over the bottom surface of the rim 22 to eventually clear the rim 22 and allow the rim 22 to be withdrawn from the rounded channel 310.

As with the other embodiments described above, the upper surface of the top wall 104 on lid 300 defines the circular central area 160, which can be advantageously used as a platform for advertisement or promotional messages 162 as previously described.

Figure 15:
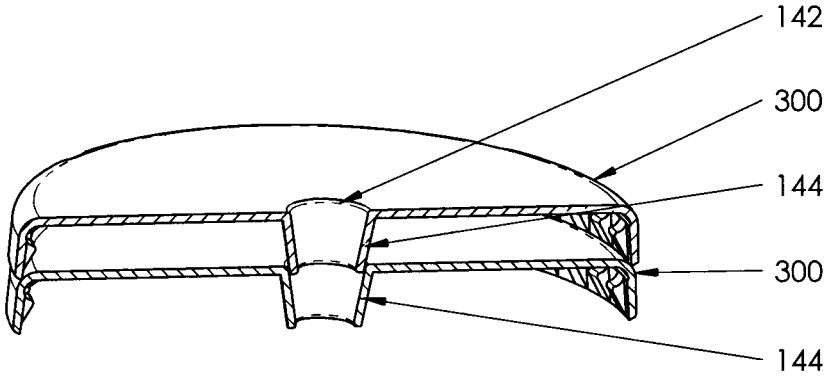
FIG. 15 is a cross section view of the lids of FIG. 10 in a stacked configuration.

As shown in FIG. 15, the lids 300 are stackable so that users can save storage space on a lid counter, warehouse and the like by simply stacking the lid on the top of each other.

Figure 16:
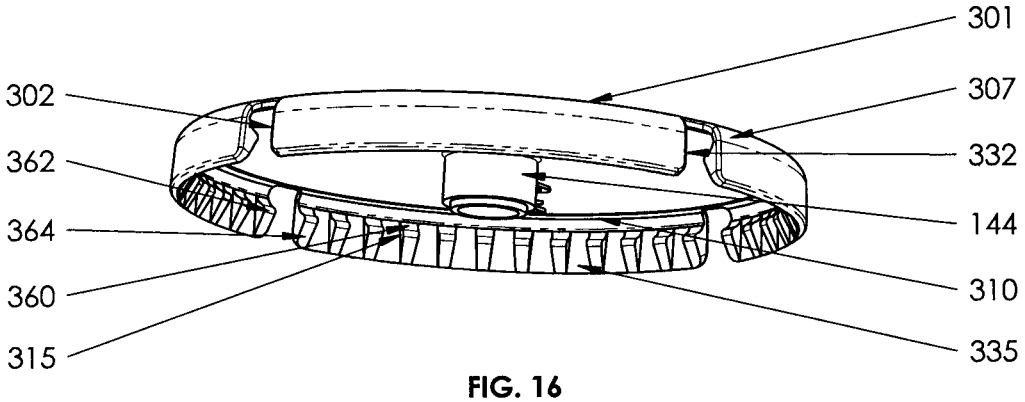
FIG. 16 is a perspective view of another embodiment of a lid of the present invention.

Referring to FIG. 16, there is shown another embodiment of a closure lid in accordance to the present invention. Lid 301 is similar to lid 300 in all aspects except that the projections 315 are thicker than projections 314 on lid 300, and the slots 332 on lid 301 extend from the bottom-most edge 335 of the skirt up to the edge 307 of the top wall so as to reveal a portion of the rim 22 through the slots 332. Thereby, slots 332 provide a window by which a user can confirm that the rim 22 is received completely within the round channel and thereby confirm that the lid 301 is sealed and locked in an operative position on the rim 22. In some embodiments, a status display may be provided based on different status indictors such as color, symbols and the like that may be visible through the slots 332 by which a user could readily ascertain the status of the lid 301. In some embodiments, the lid 301 may be provided with vertical downward extending tabs similar to tabs 166 shown in FIG. 5 from the bottom surface of the top wall at locations peripherally coincident with the slots 332 but located laterally inward from the edge of the top wall by a distance approximately equal to the thickness of the bead or rim 22 on the cup 20. Thus the bead or rim 22 would fit between the rounded channel 310 and the tabs 166 as shown in FIG. 5. In such embodiments, the tabs 166 provide a more secure liquid seal against the bead or rim 22 at locations coincident with the slots 332.

Figure 17:
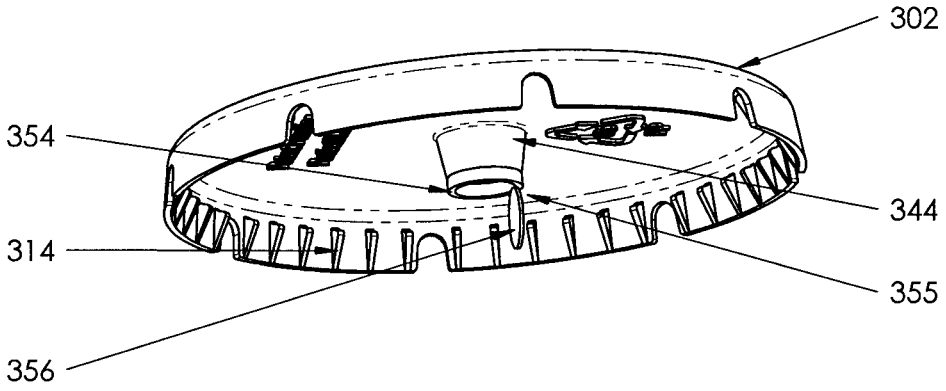
FIG. 17 is a perspective view of another embodiment of a lid of the present invention.
Figure 18:
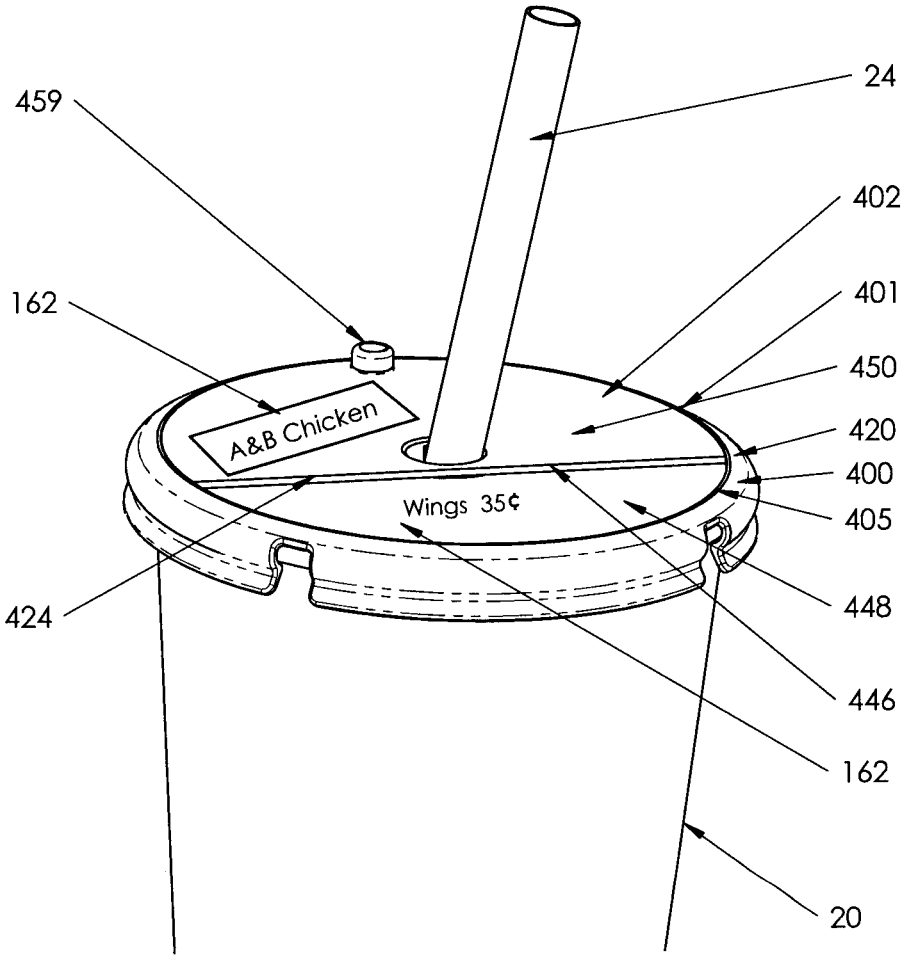
FIG. 18 is a perspective view of another embodiment of a lid of the present invention on a beverage cup.

Referring to FIG. 17, there is shown another embodiment of a closure lid in accordance with the present invention. Lid 302 is similar to lid 300 in all aspects except that the bottom straw receiver edge 354 of the straw receiver 344 includes a flap valve 355 comprising of a disk 356 that is connected along a portion of its edge to the bottom of the straw receiver 344. The diameter of the disk 356 is the same as the diameter of the bottom of the straw receiver 344, and in its resting state, the disk 355 abuts the bottom straw receiver edge 354 to provide a degree of sealing so as to limit the escape of liquid from the cup via the straw receiver 344 that might result from an increased pressure within the cup, for example, as a result of squeezing or dropping the cup. When a user inserts a straw into the straw receiver 344, the leading edge of the straw deflects the disk 356 outward as a result of the flexible material connection between the disk 356 and the bottom straw receiver edge 354. Once the straw is removed from the straw receiver, the disk 356 returns to the resting state as a result of the resilience of the connecting material. It should be understood that a straw receiver as described herein in relation to lid 302, having a flap valve 355, could be used on the other embodiments of the lids of the present invention.

Referring to FIGS. 18-22, there is shown another embodiment of a closure lid in accordance with the present invention. Lid 401 comprises a main lid 400 and a planar circular upper disk portion 402 that is releasably and rotatably connected to the main lid 400. In the illustrated embodiment, the main lid 400 is in all aspects the same as lid 100 except that the planar top surface 448 of the top wall 404 is sunken downward somewhat relative to the upper edge 420 of the lid to define circumferential shoulder 405. The other structures of the main lid 400 are the same as the lid 100.

Figure 19:
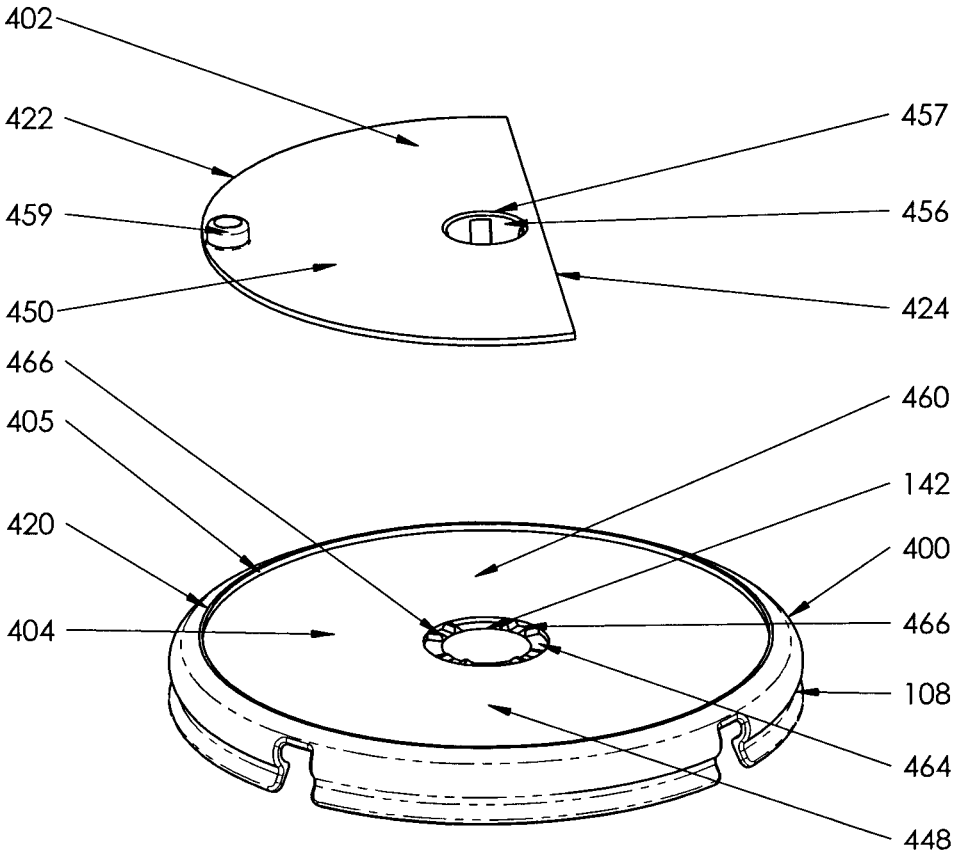
FIG. 19 is a perspective view of the lid of FIG. 18.

As shown in FIG. 19, the upper disk 402 is a partial planar circular disk having a circular edge portion 422 and a straight edge portion 424. The upper disk portion 402 is cooperatively dimensioned relative to the main lid 400 such that the upper disk 402 nests within the void defined by the shoulder 405 and the top surface 448, preferably in a manner that the circular edge 422 nearly abuts shoulder 405, and the top surface 450 is flush with the upper edge 420 of the main lid 400 when the two are assembled. As a result of the upper disk 402 being a partial disk, it partially covers the top surface 448 of the main lid 400 when the two are assembled, leaving that part of the top surface 448 visible that coincides with the missing portion of the upper disk 402. Accordingly, the upper disk 402 defines a window 446 that renders a portion of the top surface 448 of the main lid 400 visible.

On the bottom surface 452 of the disk 402 is provided with a plurality of downward and inward extending tabs 456 arranged in a circular manner around the periphery of a hole 457. The combined external shape defined by the tabs 456 is that of an inwardly tapered cylinder that is dimensions to be closely received within the straw receiver 144 of the main lid 400. In the assembly configuration, each tab 456 extends slightly below the bottom straw receiver edge 154 of the straw receiver 144, and includes an outward flange portion that is adapted to releasably engage the bottom straw receiver edge 154. Hence the disk portion 402 releasably connects to the main lid 400 by virtue of a snap fit of the tabs 456 being received within the straw receiver 144 and the flange portions 458 engaging the bottom straw receiver edge 154. As well, the disk portion 402 is able to rotate relative to the main lid 400. To assist in rotating the upper disk, a protrusion 459 is provided on the top surface 450 of the disk near an edge that provides a grip member by which a user can manipulate the upper disk 402. The hole 457 as well as the internal dimensions of the tapered cylinder defined collectively by the tabs 456 is sufficient to enable a straw 24 being inserted there through such that a straw may be inserted through both the disk 402 and the main lid 400 when the two are assembled.

The top surface 448 of the main lid defines a central area 460 may carry advertising messages 162 as described above. The positioning and configuration of the messages 162 may be advantageously arranged such that one or several messages may be selectively displayed by rotating the upper disk 402 and positioning of the window 446 relative to the top surface 448. For example, a restaurant may display advertising messages on the main lid but the partial advertising message is hidden by the upper disk. A promotion or game may be created whereby a customer reveals the hidden message or promotion by simply rotating the upper disk relative to the main lid. In addition, advertising messages may be placed on the top surface 450 of the upper disk 402 upper lid in conjunction with or in the alternative to advertising messages on the main lid 400. For example, a third party advertiser, in cooperation with a fast food restaurant, may have upper disks produced for it containing advertisements on the top surface 450 to promote brand awareness. These upper disks may be placed upon the main lids used at the restaurant.

Figure 20:
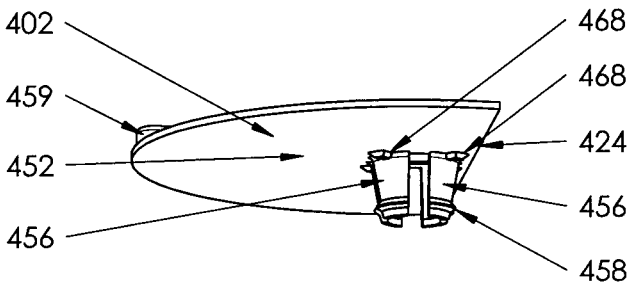
FIG. 20 is a perspective view of the lid of FIG. 18.
Figure 20:
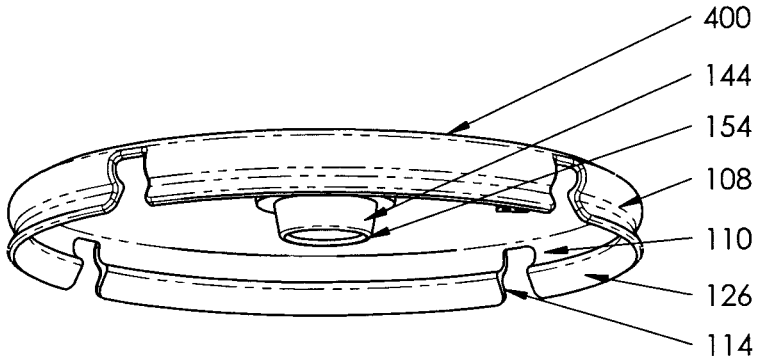
Figure 21:
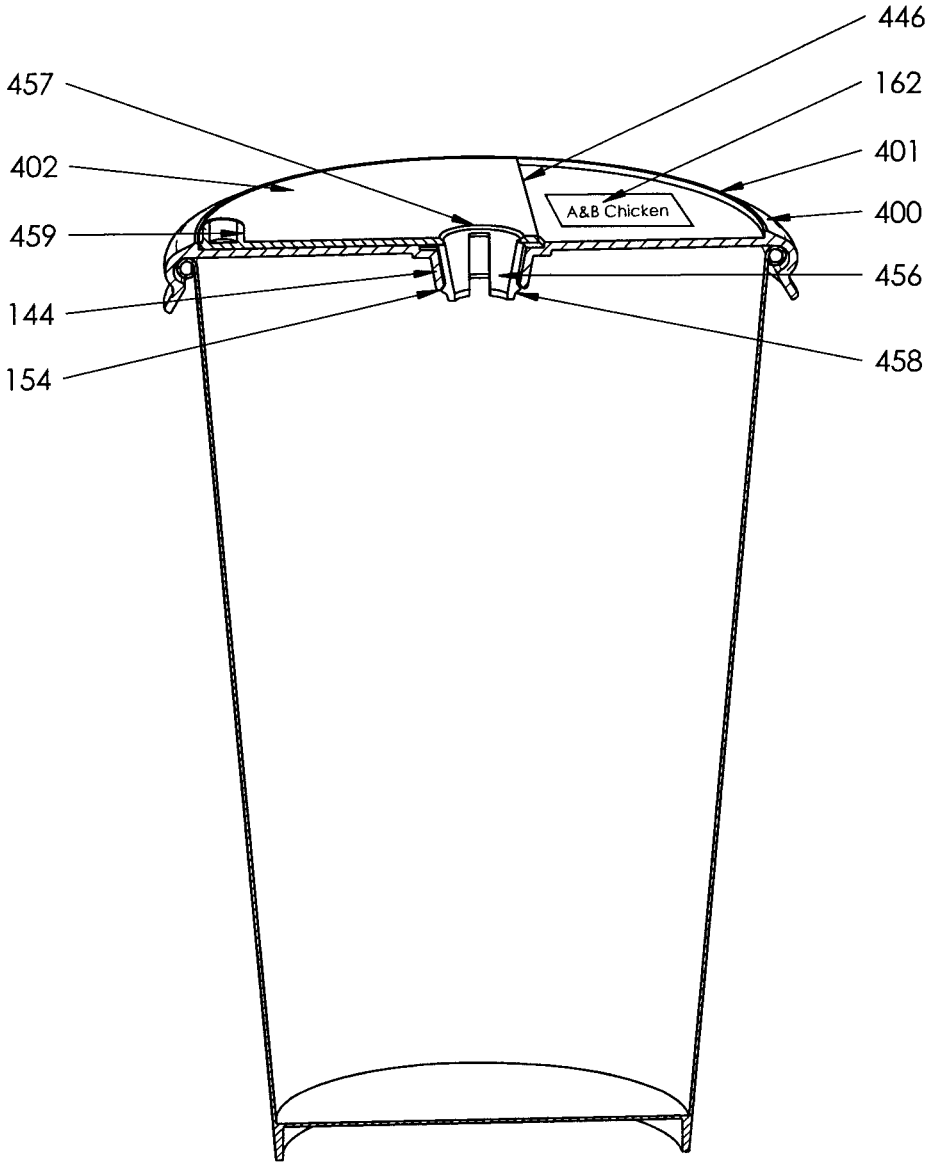
FIG. 21 is cross section view of the lid of FIG. 18 on a beverage cup.

Referring to FIGS. 19 and 20, the upper disk 402 and the main lid 400 are provided with detents that check the rotation of the upper disk 402 relative to the lid 400. Specifically, circumferential groove 464 is provided surrounding the hole 142, and several pairs of parallel protrusions 466 are spaced within the groove 464. On the bottom surface 452 of the disk 402 are provided protrusions 468 that are located and spaced so as to travel within the groove 464 in the assembled lid 400 as the upper disk is rotated. The protrusions 466 and 468 are adapted to provide a degree of interference with each other during the application of a certain rotational force to the upper disk, but the interference may be overcome by the application of a greater rotational force. Accordingly, the protrusions 468 may seat within the parallel protrusions 466 to provide a detent tending to resist further rotation of the upper disk. The location of the detents determines the location of the window 446, and thus the part of the top surface that is exposed at a particular detent. This feature may be used to locate varying promotional messages on the top surface in a manner that corresponds to the location of the window at the various detent positions. The number and location of detent positions may be varied as desired.

While not shown in the illustrations, the rotational movement of the upper disk 402 relative to the main lid 400 may be restricted in one direction (clockwise or counterclockwise) by providing a ratchet mechanism, for example, between the shoulder 405 and the circular edge portion 422, between the top surface 448 and the bottom surface 452, or between the straw receiver 144 and the tabs 456. Such mechanism may be used to selectively display different promotional messages or provide access to peel-off coupons or the like.

The upper disk 402 can be attached on the main lid 400 by inserting the tabs 456 of the upper disk into the straw receiver 144 of the main lid until the flange portions 458 protrude past and engage the bottom straw receiver edge 154. The upper disk 402 can be removed from the main lid 400 by compressing the bottom of the tabs 456 until the flange portions 458 can clear the bottom straw receiver edge 154 and withdrawn from the straw receiver 144.

It will be understood that alternate structures may be provided for releasably and rotatably connecting the upper disk 402 to the main lid 400. By way of example, the upper disk may be received into a complementary channel provided in the shoulder 405 that overlies a portion of the circular edge portion 422 of the upper disk to provide a snap fit there between. Instead of a channel in the shoulder, the disk may be retained on the lid by small protrusions or tabs provided on the periphery of the shoulder to overly a portion of the circular edge 422. The tabs 456 in such embodiments may be omitted.

In some embodiments, the bottom surface 452 of the upper disk 402 may carry advertising messages or promotional messages. For example, the bottom surface of the upper disk may contain a scratch and win play piece or award prizes that are revealed only when the upper disk 402 is removed from the main lid 400. This advertising medium is beneficial for fast food restaurants to advertise or promote their products and services using the planar areas of the upper disk and/or the main lid. Advertising messages may be placed thereon using removable or permanent stickers or preferably in-mold labeling (IML) processes for cost effective high volume production.

Figure 22:
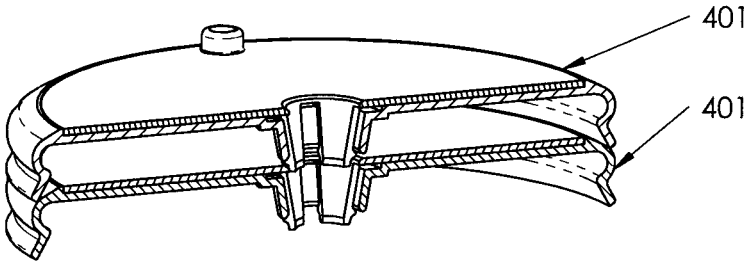
FIG. 22 is a cross section view of the lids of FIG. 18 in a stacked configuration.

As shown in FIG. 22, the assembled lids 401 are stackable so that users can save storage space on a lid counter, warehouse and the like by simply stacking the lid on the top of each other.

Figure 23:
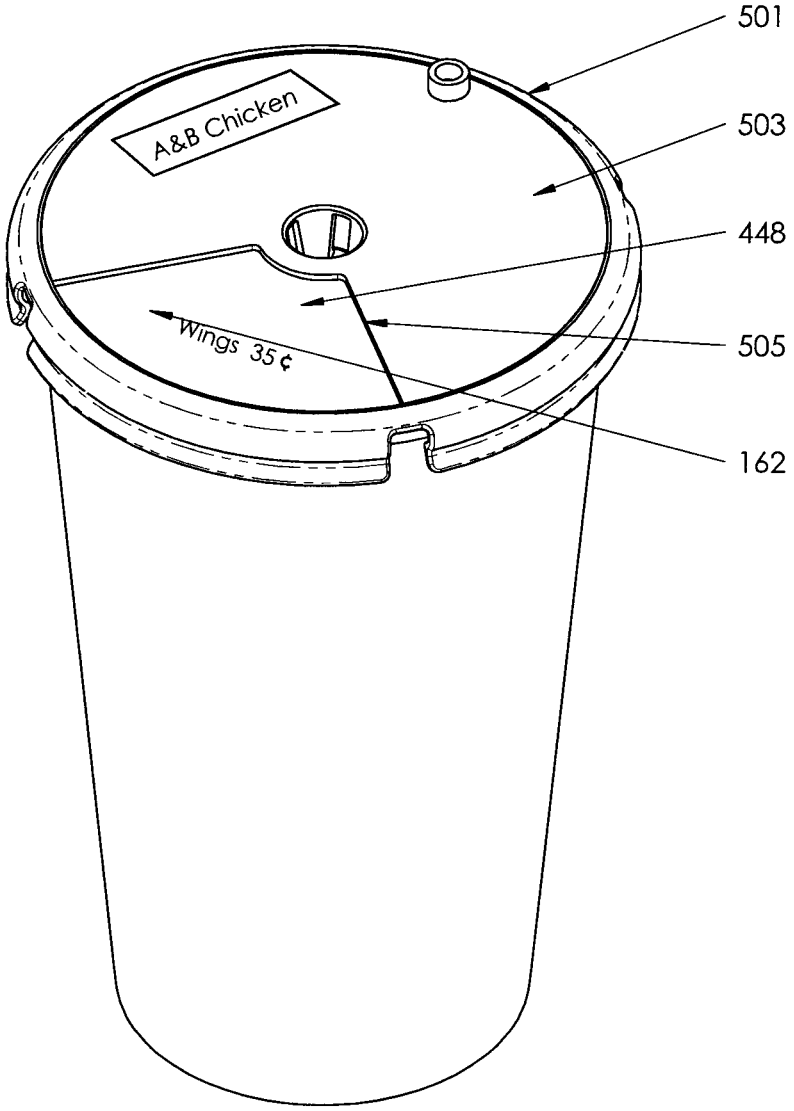
FIGS. 23 and 23*a* are perspective views of another embodiment of a lid of the present invention on a beverage cup and in an exploded view.
Figure 23A:
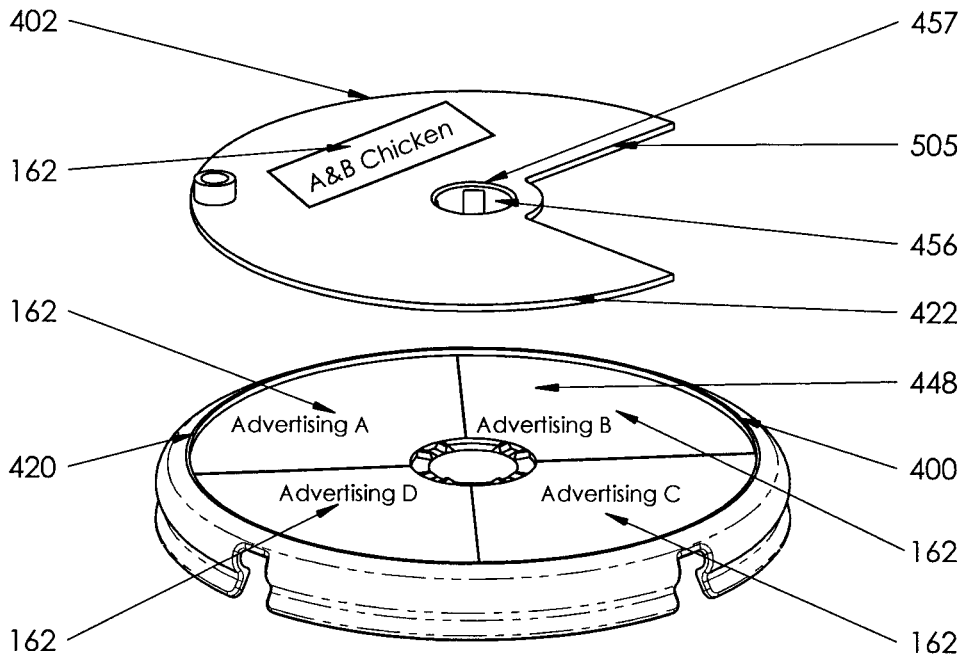
Figure 24:
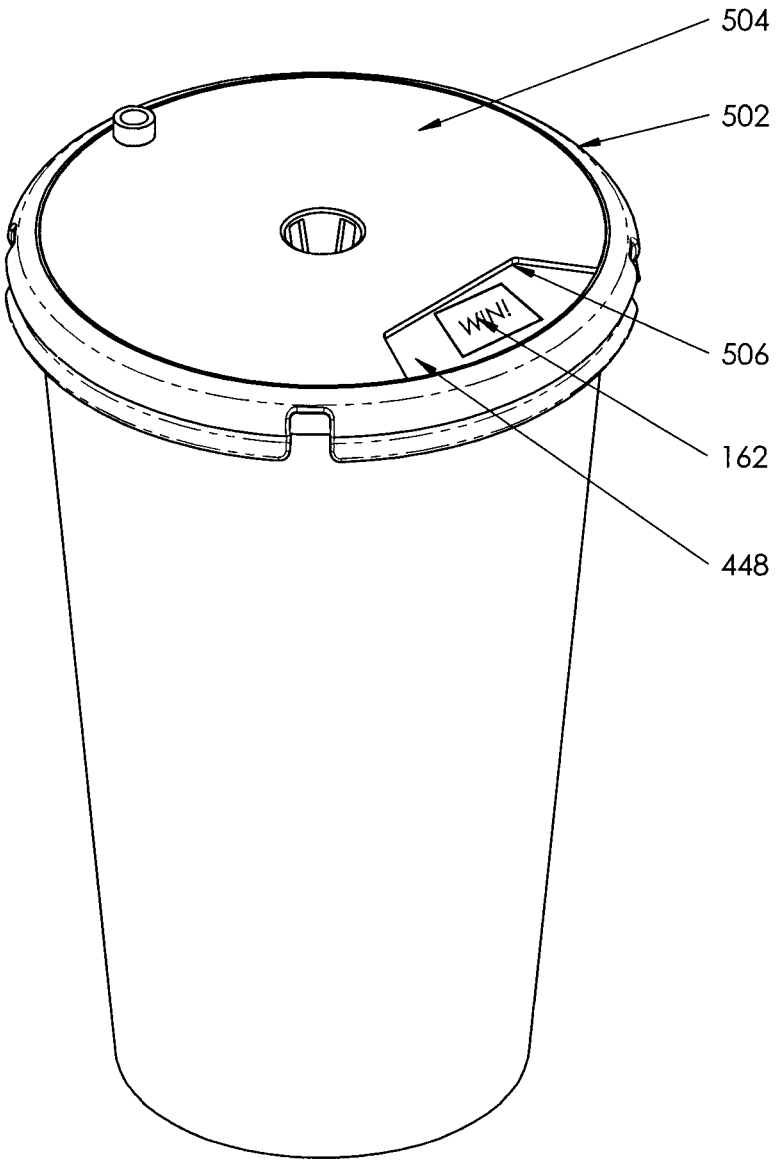
FIGS. 24 and 24*a* are perspective views of another embodiment of a lid of the present invention on a beverage cup and in an exploded view.
Figure 24A:
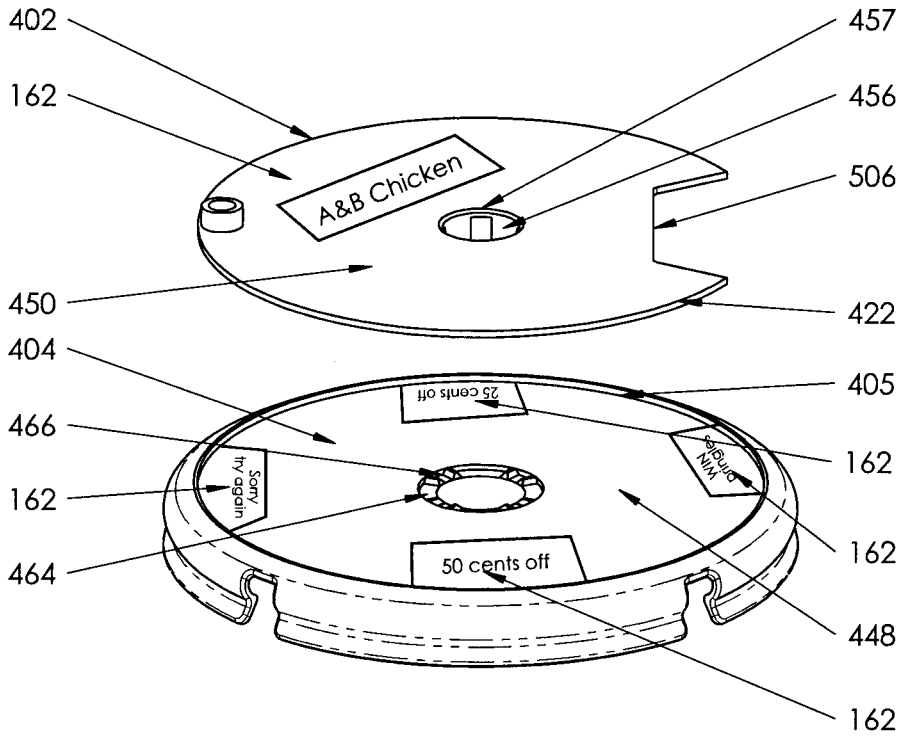

Referring to FIGS. 23-24*a*, there are shown two other embodiments of a closure lid in accordance with the present invention. Lids 501 and 502 are similar to lid 400 in all aspects except the configuration of the upper disk portions 503 and 504 in regards to the size and location of the windows 505 and 506 defined therein. It will be apparent that the configuration of the window (446, 506, 506) in the upper disk determines the size and location of the portion of the top surface 448 that is revealed, and thereby provides flexibility in the design of the underlying advertising messages or game play.

The planar areas of the lids of the present invention may carry any advertising or promotional messages which may be written or printed in a paper, plastic, transparent screen materials and the like which can be placed on the disk or lids using different labeling processes. Other materials can be used such as transparent LED display, see-through LED screen, transparent hologram screen film, transparent LCD, flexible image display, digital screen and the like. For example, a restaurant may display four advertising messages for different product and service on the center areas of the main lid, and then a customer finds out the promotional messages by simply rotating the upper disk to learn the other partial messages or prizes of the lower lid while still looking at the displayed messages on the surface of the upper lid. The promotional messages for example may be organized in areas of the lower lid relative to the windows on the upper disk for easy visibility and usage of the messages. Peel-off stickers for prizes may be printed and placed on locations of the lower lid or one printed sticker with four promotional advertising on the lower lid. For example, prizes can be sealed until they are peeled off or scratched by a customer and prizes can be randomly selected so that every customer has a chance to win a prize. The rotational movement of the upper disk can be configured by the location of detents so that the disk rotates in different turns at a time, for example at 90 degree relative to the lower lid so as to display different promotional messages with each turn. The number and configuration of the rotation or turns can vary with the design parameters.

Figure 25:
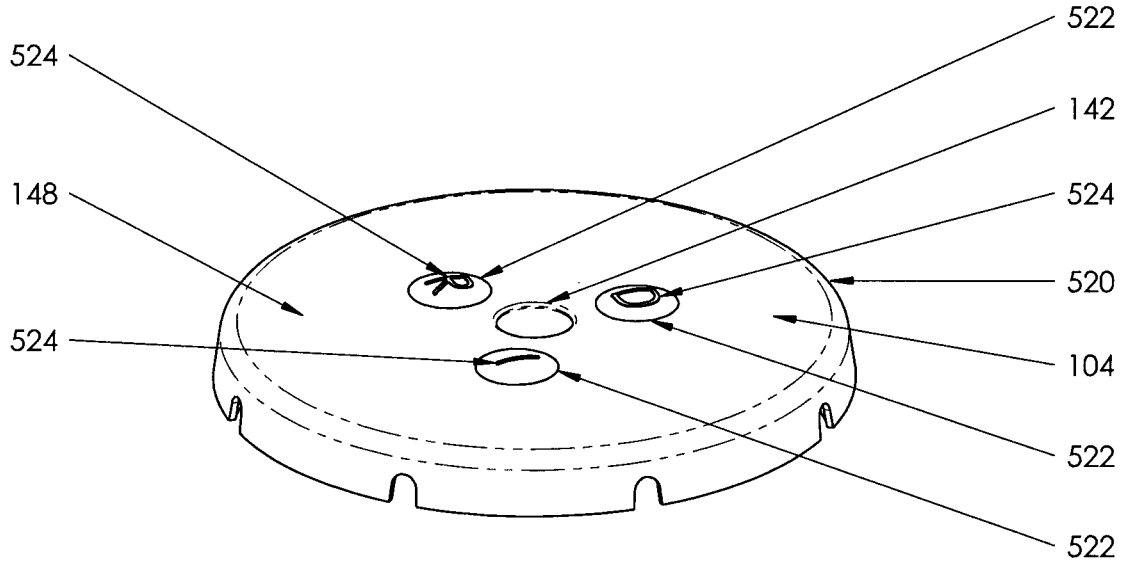
FIG. 25 is a perspective view of another embodiment of a lid of the present.

Referring to FIG. 25, there is shown another embodiment of a closure lid in accordance with the present invention. Lid 520 is similar in all respects to lid 300 except a plurality of dimples or push bubble indicators 522 are provided in the top surface of the lid by which the contents of the cup 20 may be visually indicated. Preferably, the push bubble indicators 522 are formed thinner than the top wall 104. In embodiments where advertisement messages are to be placed on the top surface of the lid using a preferred method of in-mold labeling (IML), the thickness of the bubble indicators 522 is important in order to retain the functionality of the indicators, namely of remaining depressed after an application of force as opposed to springing back out. It has been discovered that using a thickness of the material for the bubble indicators that is in the range of 25%-45% of the thickness of the top wall will provide a properly functioning button indicator even when the bubble indicator has an IML label overlying it. If the bubble indicator is too thick, the material resilience combined with the added resilience provided by the overlying IML label causes the bubble to spring back and prevents it form remaining depressed. Accordingly, in embodiments of the lids of the present invention in which the top wall thickness is about 1 mm., the preferred bubble thickness would be in the range of 0.25-0.45 mm. Preferably, a letter 524 is formed into the top surface of each push bubble indicator 522 that corresponds to the contents of the cup 20, for example the letter "D" could indicate a diet soda, "R" could indicate a root beer soda, and the like. The push bubble indicators may be permanently deflected inward by the application of pressure even when an in-mold label is applied to the top surface 148.

It should be understood that variants of the illustrated embodiments are possible in which the various features may be combined in different ways. For example, the locking mechanism of the lid 300 or 301 may be used on lids having the upper disk and main lid structure as in embodiments 401, 501 and 502. As well, a straw receiver as in embodiment 302 may be used in relation to the other embodiments.

The locking mechanisms of the present invention provide a very secure lock and attachment of the lids to the cup rim. Thus, the lid structure effectively passes the typical impact experienced by a cup full of liquid beverage during the squeeze, drop and pass test, wherein the cup is squeezed by a user, the cup is dropped over a solid surface, and the cup is removed from one spot to another without the lid separating from the cup.

The lids of the present invention may be made of plastic or other sufficiently flexible but relatively inelastic material such as flexible high density polypropylene, polystyrene, polyethylene, polyurethane, other lightweight materials and the like. Further, the various components of the present invention may be made of different materials and by any suitable manufacturing processes. The lids of the present invention may be made to any size and shape as required, for example by fast food industry, beverage companies and the like.

Figure 26:
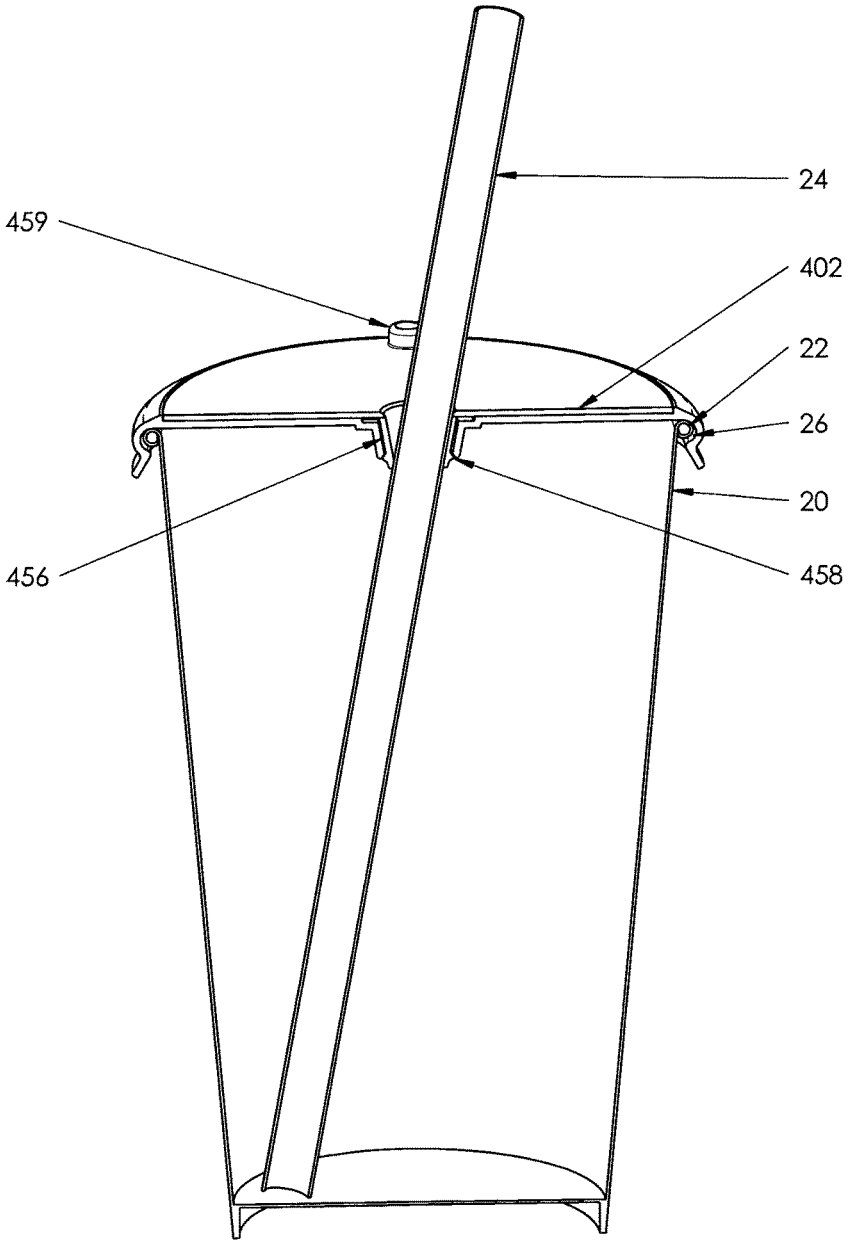
FIG. 26 is a cross section view of an embodiment of an upper disk in accordance with the present invention used in conjunction with a prior art lid shown on a cup.
Figure 27:
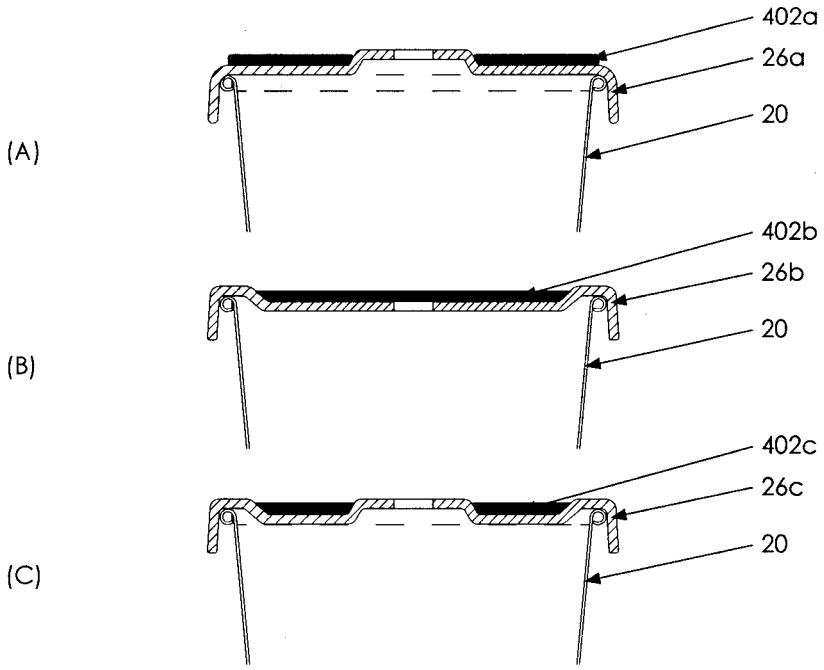
FIG. 27*a-c* are cross section views of embodiments of upper disks cooperatively dimensioned to fit with different prior art lids.

Referring to FIG. 26, there is shown an embodiment of the upper disk 402 being used on a conventional lid 26 for interactive promotional purposes. The upper disk 402 may be cooperatively dimensioned such that the upper disk can be positioned over the conventional lid 26 whereby the tabs 456 of the disk 402 may be received within the straw slots of the conventional lid 26. Accordingly, the interior space defined by the tabs 456 of the disk 402 conveniently provides a straw receiver. The disk may be a complete circular disk, or it may be a partial disk in which case it defines a window. The upper disk is rotatable in relation to the conventional lid 26. The top and/or bottom surfaces of the disk may carry advertisement or promotional messages thereon as described above. For example, a restaurant may display an advertising message on the upper disk on either the top surface, the bottom surface, or both. The upper lid can be configured to fit in to existing lids. The upper lid configuration may comprise any suitable numerous dimensions and materials depending on the design parameters. The upper disk and prior art lids may be cooperatively dimensioned such that the upper disk can be received within the spaces defined by the prior art lids. Referring to FIG. 27*a-c*, there are shown some examples of upper disk configurations 402*a*, 402*b* and 402*c* that are cooperatively dimensioned to fit with different prior art lids 26*a*, 26*b* and 26*c*.

Figure 28:
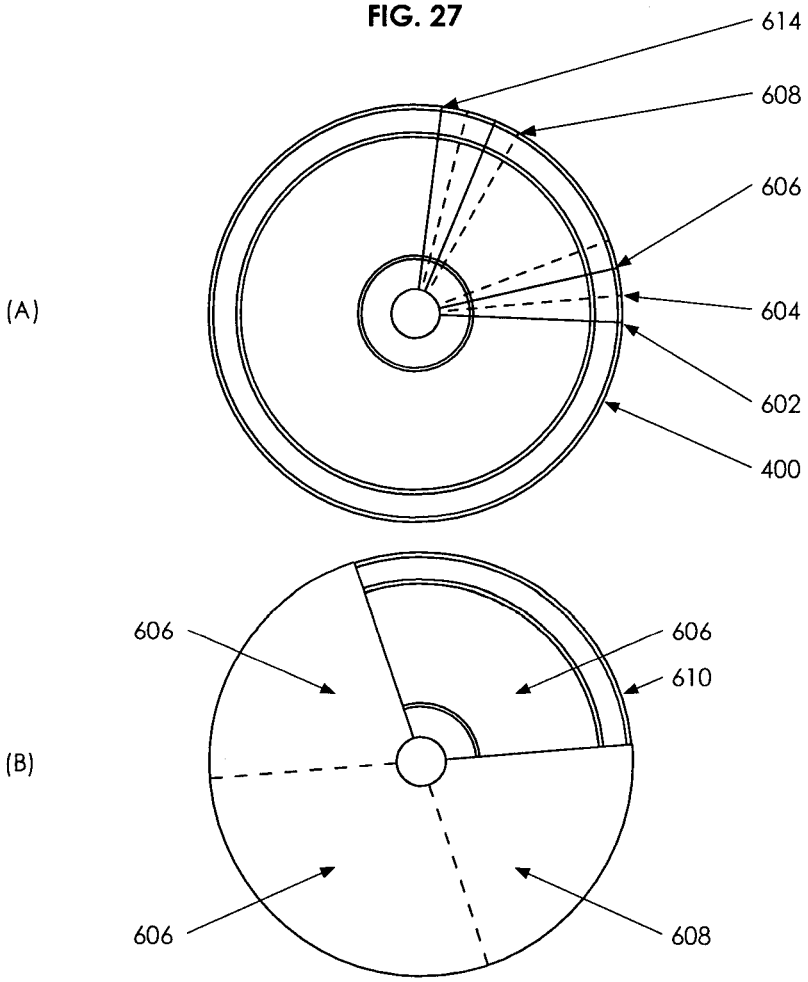
FIG. 28*a-b* are top plan views of another embodiment of an upper disk.

Referring to FIG. 28*a-b* there is shown an embodiment of an upper disk that may be configured to be foldable or collapsible, for example, into four sections 602, 604, 606 and 608, and then the sections are stretchable using the post 614 to any clockwise or counterclockwise directions to display any advertising or promotional messages on the lower lid 400. The foldable or stretchable direction can be in a vertical movement from the straw hole to each side of the upper corner of the upper disk so that the promotional messages on the upper disk can be in a clearly visible display for a customer. The present invention may comprise any suitable numerous dimensions and configurations of the lids. The present invention may comprise any suitable dimensions of lid sizes. Different lid sizes or designs or turns or foldable or stretchable ways and materials may be used with the present invention. In addition, all of the mentioned above embodiments can be used to accomplish the upper lid promotional purposes.

Other aspects and features of the present invention will become apparent to those of ordinary skill in the art upon review of the following description of specific embodiments of the invention in conjunction with the accompanying figures.

While the above description and illustrations constitute preferred or alternate embodiments of the present invention, it will be appreciated that numerous variations may be made without departing from the scope of the invention. It is intended that the invention be construed as including all such modifications and alterations.

What is claimed is:

1. A lid for a paper beverage cup having an external peripheral rolled rim at the upper end thereof, the lid comprising:

a top wall;

a peripheral skirt depending downward from the top wall and having a bottom-most edge larger in diameter than the rolled rim of the paper beverage cup and an inside surface with a locking mechanism disposed between the bottom-most edge and the top wall and being adapted to receive and engage the rolled rim of the paper beverage cup;

a plurality of slots defined in the skirt extending upward from the bottom-most edge to divide the skirt into individually resiliently flexible skirt portions wherein the slots permit each flexible skirt portion to be temporarily deflected outward as the lid is urged onto the rolled rim to facilitate the skirt being telescoped onto the rolled rim, and wherein the flexible skirt portions return to a resting state in which the locking mechanism of the skirt engages the rolled rim to secure the lid onto the rolled rim of the paper beverage cup; and a straw receiver comprising a hole defined in the top wall and an inwardly tapered cylinder that projects downward from a bottom surface of the top wall about the hole, the tapered cylinder defining a bottom straw receiver edge adapted to closely receiving a straw therein.

2. The lid of claim 1 wherein the locking mechanism comprises:

a circumferential rounded channel provided on the inside surface at an interface between the skirt and the top wall and adapted to receive an upper circumferential portion of the rolled rim; and a plurality of peripherally spaced inwardly directed projections on the inside surface below the rounded channel and adapted to underlie and engage a bottom portion of the rolled rim.

3. The lid of claim 2 wherein each inwardly directed projection comprises:

a downwardly and inwardly sloping concave upper surface adapted to cradle the bottom portion of the rolled rim;

an inward convex intermediate surface adapted to underlie the bottom portion of the rolled rim; and a downwardly and outwardly sloping lower surface extending from the intermediate surface to the bottom-most edge of the skirt, wherein as the bottom-most edge of the skirt is telescoped onto the rolled rim in placement of the lid onto the paper beverage cup, the lower surface rides on the rolled rim to deflect its skirt portion outward against a bias provided by the resilience of the skirt portion material until the intermediate surface clears the rolled rim and the rolled rim seats into the rounded channel and into engagement with the upper surface as the skirt portion springs back to the resting state.

4. The lid of claim 1 wherein the locking mechanism comprises:

a circumferential rounded channel provided on the inside surface at an interface between the skirt and the top wall and adapted to receive the rolled rim;

an inward annular flange projecting from the inside surface below the rounded channel and adapted to underlie and engage a bottom portion of the rolled rim; and a flared downward lower surface extending from the annular flange to the bottom-most edge of the skirt, wherein as the lower surface of the skirt is telescoped onto the rolled rim in placement of the lid onto the paper beverage cup the lower surface rides on the rolled rim to deflect its skirt portion outward against a bias provided by the resilience of the skirt portion material until the annular flange clears the rolled rim and the rolled rim seats into the rounded channel and into engagement with the annular flange as the skirt portion springs back to a resting state.

5. The lid of any one of claims 1-4, wherein the slots extend fully to the top wall to expose a portion of the rolled rim for enabling visual confirmation that the rolled rim is fully seated within the locking mechanism.

6. The lid of claim 1 further including a valve on the tapered cylinder for preventing liquid from escaping via the tapered cylinder in the absence of a straw in the tapered cylinder.

7. The lid of claim 6 wherein the valve comprises one flap hingedly connected to the bottom straw receiver edge by a segment of resiliently flexible material, and adapted to cover the bottom straw receiver edge in a resting state for providing a seal, and be moveable away from the bottom straw receiver edge upon insertion of a straw through the tapered cylinder and snapping back to the bottom straw receiver edge upon withdrawal of the straw.

8. The lid of claim 1 further including a disk member adapted for rotatably connecting onto the top wall in a manner that the disk member obscures an upper surface of the top wall, the disk member further defining a window through which a portion of the upper surface is visible, thereby enabling portions of the upper surface to be displayed through the window by rotating the disk member relative to the top wall.

9. The lid of claim 8 further including a plurality of messages provided on the upper surface positioned such that one or more of the messages may be selectively displayed through the window by rotation of the disk relative to the top wall.

10. The lid of claim 9 further including detents cooperating between the disk and the top wall that enable the window to be biased in one or more positions relative to the upper surface.

11. The lid of claim 8 wherein the disk member includes:

a second hole coincident with the hole on the top wall; and one or more tabs extending downward from the disk member about the second hole and being adapted to fit within the tapered cylinder and extend past the bottom straw receiver edge thereof, the one or more tabs including an outward flange portion adapted to releasably engage the bottom straw receiver edge to resist the withdrawal of the one or more tabs from the tapered cylinder, wherein the connection between the one or more tabs and the tapered cylinder permits rotation of the disk member relative to the top wall.

12. The lid of claim 11 further including a plurality of messages provided on the upper surface positioned such that one or more of the messages may be selectively displayed through the window by rotation of the disk relative to the top wall.

13. The lid of claim 12 further including detents cooperating between the disk and the top wall that enable the window to be biased in one or more positions relative to the upper surface.

14. The lid of any one of claims 1-4 further including a plurality of bubble indicators protruding from the top surface of the top wall, each being inwardly deformable upon an application of an inward force.

15. The lid of claim 14 further including an in-mold label (IML) formed into the top surface of the top wall and overlying the bubble indicators, and wherein the thickness of the material of each bubble indicator is between about 25%-45% of the thickness of the material of the top wall.

* * * * *